US008429946B2

(12) United States Patent
Maeda et al.

(10) Patent No.: US 8,429,946 B2
(45) Date of Patent: Apr. 30, 2013

(54) PRESS-WORKING METHOD, AND PRESS-WORKING APPARATUS

(75) Inventors: Shingo Maeda, Tochigi (JP); Hideo Meguri, Tochigi (JP); Seiji Takahashi, Tochigi (JP); Yuichi Nagai, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 792 days.

(21) Appl. No.: 12/445,527

(22) PCT Filed: Oct. 15, 2007

(86) PCT No.: PCT/JP2007/070104

§ 371 (c)(1),
(2), (4) Date: Apr. 14, 2009

(87) PCT Pub. No.: WO2008/047764

PCT Pub. Date: Apr. 24, 2008

(65) Prior Publication Data

US 2010/0018280 A1 Jan. 28, 2010

(30) Foreign Application Priority Data

Oct. 17, 2006 (JP) ..... 2006-282993
Oct. 17, 2006 (JP) ..... 2006-282994
Oct. 17, 2006 (JP) ..... 2006-282995

(51) Int. Cl.
*B21D 22/21* (2006.01)

(52) U.S. Cl.
USPC ..... 72/350; 72/351; 72/453.13

(58) Field of Classification Search ..... 72/348, 72/361, 350, 60, 296, 305, 63, 347, 342.8, 72/420, 709, 456, 351, 394, 396, 399, 403, 72/72/465.1, 297, 57, 342.7, 453.01, 453.13, 72/379.2, 381, 382, 383, 384
See application file for complete search history.

(56) References Cited

U.S. PATENT DOCUMENTS 4,779,443 A * 10/1988 Hoshi ..... 72/349
5,372,027 A * 12/1994 Roper et al. ..... 72/60

(Continued)

FOREIGN PATENT DOCUMENTS

JP 57-052525 3/1982
JP 63-013626 1/1988

(Continued)

OTHER PUBLICATIONS

Edited by Puresu Kako Nouhau Henshu linkai, "Puresu Kako Nouhau 100 Dai", The Nikkan Kogyo Shinbun, Ltd., Jan. 30, 1975, pp. 98-99. (English abstract included).

*Primary Examiner* — Dana Ross
*Assistant Examiner* — Homer Boyer
(74) *Attorney, Agent, or Firm* — Rankin, Hill & Clark LLP

(57) ABSTRACT

A press-working apparatus capable of forming a clear character line. The press-working apparatus forms a product having a character line. The press-working apparatus comprises an upper die and a lower die arranged across a steel sheet, an upper die mechanism for moving the upper die toward and away from the lower die, a first holder and a second holder for clamping the steel sheet and applying an unwrinkling force to the same, and a control unit for controlling the upper die mechanism and the first holder. The upper die is divided on the character line of the product into a first upper die and a second upper die. The control unit makes the unwrinkling force by the first holder stronger than that by the second holder, so that the steel sheet is press-worked by the second upper die and then by the first upper die.

11 Claims, 29 Drawing Sheets

U.S. PATENT DOCUMENTS

| | | | | | |
|---|---|---|---|---|---|
| 5,600,991 | A | * | 2/1997 | Munzen | 72/348 |
| 5,794,482 | A | * | 8/1998 | Walkin | 72/350 |
| 5,966,981 | A | * | 10/1999 | Janos et al. | 72/350 |
| 5,979,210 | A | * | 11/1999 | Baur et al. | 72/350 |
| 6,032,504 | A | * | 3/2000 | Onat et al. | 72/297 |
| 6,085,571 | A | * | 7/2000 | Brinas et al. | 72/420 |
| 6,647,756 | B2 | * | 11/2003 | Nieschulz | 72/350 |
| 6,668,612 | B2 | * | 12/2003 | Kruger et al. | 72/420 |
| 6,769,280 | B2 | * | 8/2004 | Cao et al. | 72/17.3 |
| 7,210,323 | B2 | * | 5/2007 | Kruger et | 72/57 |
| 7,536,892 | B2 | * | 5/2009 | Amino et al. | 72/305 |

FOREIGN PATENT DOCUMENTS

| | | | |
|---|---|---|---|
| JP | 63-194826 | | 8/1988 |
| JP | 03-042126 | | 2/1991 |
| JP | 09-001254 | | 1/1997 |
| JP | 09-038728 | | 2/1997 |
| JP | 09-192751 | | 7/1997 |
| JP | 10-305331 | * | 9/1997 |
| JP | 10-305331 | | 11/1998 |
| JP | 11-290951 | | 10/1999 |
| JP | 2001-079617 | | 3/2001 |
| JP | 2003-079617 | | 3/2003 |

* cited by examiner

PRESS-WORKING METHOD, AND PRESS-WORKING APPARATUS

TECHNICAL FIELD

The present invention relates to a pressing method and a pressing device.

BACKGROUND ART

Conventionally, for example, a vehicle outer panel and the like is formed by press-forming of a laminated work (refer to the patent document 1). According to the press method and the press device described in this patent document 1, the blank holder holds the end part of a work, applying fold pressure to the work. Then, an upper die is lowered to press the work with the upper die and the lower die, whereby the work is press-formed.

Patent Document 1: Unexamined Japanese Patent Application, First Publication No. 63-194826

DISCLOSURE OF THE INVENTION

Problems to be Solved by the Invention

By the way, a character line may be formed on the surface of the above-mentioned vehicle outer panel. Hereinafter, the character line is an important ridge line for a design formed on the surface of a formed article such as a vehicle outer panel. This character line is formed by a providing a concave part on an upper die and providing a convex part opposed to this concave part on the lower die to press the work with the upper die and the lower die and then transcribe the concave part to the work.

Thus, when a work is pressed with such an upper die and a lower die, a work flows from both sides of a character line. However, the inflow from both sides of the character line varies by the shape of a die, which causes the position of the character line to shift. Therefore, the character line may be less clear.

In addition, on the above-mentioned vehicle outer panel, for example, a flange part with which a door engages has a portion formed into an inner corner, for example. However, such a portion formed into an inner corner is formed by forming a work formed by expansion flange forming, which may cause tensile stress to concentrate upon press-forming, thereby generating cracks on the formed article.

An objective of the present invention is to provide a pressing method and a pressing device capable of preventing deficiencies from occurring upon forming.

Means for Solving the Problems

The pressing device according to the present invention, in the pressing device forming a formed article having a character line, comprising: a first die and a second die between which a work is placed; an advancing and retrieving mechanism advancing the first die to and retrieving the first die from the second die; a holder holding the work to apply fold pressure; and a control means for controlling the advancing and retrieving mechanism and the holder, wherein the first die is divided into a first panel die and a second panel die on the character line of the formed article, the holder is placed at the sides of the first panel die and the second panel die, and the control means increases fold pressure by the holder at the sidle of the first panel die to be larger than that by the holder at the side of the second panel die to conduct press-forming of the work with the second panel die and then forms the work with the first panel die.

According to the present invention, the first die is divided into the first panel die and the second panel die to conduct press-forming of a work with the second panel die and then with the first panel die. At this point, a character line is virtually formed by press-forming with the second panel die. However, the inflow of a material from the side of the first panel die to the character line portion increases to be larger than that from the side of the second panel, which may cause the character line to shift.

Accordingly, the holder at the side of the first panel die applies fold pressure to be larger than that applied by the holder at the side of the second panel die to control the inflow of a material from the side of the first panel die. Therefore, the inflows of a material from the sides of the first panel die and the second panel die to a character line portion can be almost evenly divided to prevent the character line from shifting.

In this case, it is preferable that the holder at the side of the first panel die is provided with a fold pressure adjustment mechanism adjusting fold pressure applied to the work, and the control means controls the fold pressure adjustment mechanism to increase fold pressure by the holder at the side of the first panel die to be larger than that by the holder at the side of the second panel die. Such a fold pressure adjustment mechanism is provided, so that fold pressure by the holder at the side of the first panel die can be adjusted easily in proportion to the inflow of a material to the shape of a formed article, particularly a character line portion.

In addition, in this case, it is preferable that upon press-forming of the work with the first panel die, the work is press-formed with the first panel die while being pressed with the second panel die. This can prevent a character line from shifting and also prevent wrinkles from being generated at the portion press-formed with the second panel die.

The pressing method according to the present invention, in the pressing method for forming a formed article on which a character as a boundary is divided into a first panel face and a second panel face, comprising: a first pressing step of conducting press-forming of the second panel face under a condition in which fold pressure applied to the side of a first panel face of a work is increased to be larger than that applied to the side of the second panel face; and a second pressing step of conducting press-forming of the first panel face.

According to the present invention, a formed article on which a character as a boundary is divided into a first panel face and a second panel face is formed by press-forming of the second panel face and then the first panel face. At this point, a character line is virtually formed by press-forming with the second panel face. However, the inflow of a material from the side of the first panel face to the character line portion increases to be larger than that from the side of the second panel, which may cause the character line to shift.

Accordingly, fold pressure to be larger than that applied to the side of the second panel is applied to the side of the first panel to control the inflow of a material from the side of the first panel. Therefore, the inflows of a material from the sides of the first panel and the second panel to a character line portion can be almost evenly divided to prevent the character line from shifting.

In this case, in the second pressing step, it is preferable that the first panel face is press-formed with maintenance of a condition that the second panel is pressed. This can prevent a character line from shifting and also prevent wrinkles from being generated at the second panel of a formed article.

The pressing method according to the present invention is a pressing method of a formed article having a character line, comprising: a first pressing step of conducting of press-forming of a portion of a work to form a portion including a character line, and a second pressing step of conducting of press-forming of the remaining portion of the work.

According to the present invention, a portion including a character line of a formed article is press-formed in the first pressing step, and the remaining portion of the work is press-formed in the second pressing step. Therefore, the character line is first formed in the first pressing step, so that a character line can be clearly formed on the surface of a formed article.

In this case, in the second pressing step, it is preferable that with maintenance of a condition that a portion of the work is pressed, the remaining portion of the work is press-formed.

According to the present invention, with maintenance of a condition that a portion of the work is pressed, the remaining portion of the work is press-formed in the second pressing step. This can prevent a work from flowing from both sides of a character line, which can prevent the position of the character line from shifting.

The pressing device according to the present invention is a pressing device conducting press-forming of a formed article having a character line, comprising: a first die and a second die between which a work is placed, an advancing and retrieving mechanism advancing the first die to and retrieving the first die from the second die, and a control means for controlling the advancing and retrieving mechanism, wherein the first die is divided into a plurality of divided dies, One of the plurality of divided dies is a character line die placed over a character line of the formed article, and the control means conducts press-forming of a portion of the work with the character line die and then press-forming of the remaining portion of the work with the rest of divided dies.

According to the present invention, a portion of the work is press-formed with a character line die placed over a character line among a first die dividing into a plurality of divided dies, and the remaining portion of the work is pressed with the rest of divided dies. Thus, the character line is first formed with the character line die, so that a character line can be clearly formed on the surface of a formed article.

In this case, it is preferable that upon press-forming of the remaining portion of the work, the control means conducts press-forming of the remaining portion of the work with the rest of divided dies, with maintenance of a condition that the work is pressed with the character line die.

According to the present invention, with maintenance of a condition that the work is pressed with a character line die, the remaining portion of a work is press-formed with the rest of divided dies. This can prevent a material from flowing from both sides of the character line, which can reliably prevent the position of a character line from shifting.

The pressing method according to the present invention, in a pressing method of a formed article having an end part formed by expansion flange forming, comprising: a first pressing step of forming a portion of the work by press-forming under a condition in which fold pressure is applied to the work, and a second pressing step of forming the remaining portion of the work by expansion flange forming under a condition in which fold pressure is released to form the end part.

According to the present invention, fold pressure is released in the second pressing step, whereby a material becomes flowable between dies. A work is formed by expansion flange forming to form the end part of a formed article under this condition, which can prevent cracks due to material shortage from being generated at the end part of a formed article. In addition, a portion other than the end part is press-formed before the end part in the first pressing step, which can prevent wrinkles from being generated at a portion adjacent to the end part.

In this case, in the second pressing step, it is preferable that with maintenance of a condition a portion of the work is pressed, the remaining portion of the work is formed by expansion flange forming. This can reliably prevent wrinkles from being generated at a portion adjacent to the end part.

The pressing device according to the present invention, in a pressing device conducting press-forming of a formed article having an end part formed by expansion flange forming, comprising, a first die and a second die between which a work is placed, an advancing and retrieving mechanism advancing the first die to and retrieving the first die from the second die, a holder holding a work, a control means for controlling the advancing and retrieving mechanism and the holder, wherein the first die is divided into a plurality of divided dies, and the control means forms a portion of the work by press-forming with the work held, using at least one of the plurality of divided dies, and then forms the remaining portion of the work by expansion flange forming with the work unheld, using the rest of the plurality of divided dies, to form the end part.

According to the present invention, the holder unholds a work to release fold pressure applied to the work, whereby a material becomes flowable between dies. A work is formed by expansion flange forming to form the end part of a formed article under this condition, which can prevent cracks due to material shortage from being generated on a formed article. In addition, a portion other than this end part is press-formed before the end part to be formed by expansion flange forming, which can prevent wrinkles from being generated at a portion adjacent to the end part.

In this case, it is preferable that upon forming the end part, with maintenance of a condition that the work is pressed with at least one of the plurality of divided dies, the control means forms the remaining portion of the work by expansion flange forming, using the rest of the plurality of divided dies. This can prevent wrinkles from being generated at a portion adjacent to the end part.

Effects of the Invention

According to the pressing device of the present invention, the first die is divided into the first panel die and the second panel die to conduct press-forming of a work with the second panel die and then with the first panel die. At this point, a character line is virtually formed by press-forming with the second panel die. However, the inflow of a material from the side of the first panel die to the character line portion increases to be larger than that from the side of the second panel, which may cause the character line to shift. Accordingly, the holder at the side of the first panel die applies fold pressure to be larger than that applied by the holder at the side of the second panel die to control the inflow of a material from the side of the first panel die. Therefore, the inflows of a material from the sides of the first panel die and the second panel die to a character line portion can be almost evenly divided to prevent the character line from shifting.

According to the pressing method and the pressing device of the present invention, a portion including a character line of a formed article is press-formed in the first pressing step, and the remaining portion of the work is press-formed in the second pressing step. Therefore, the character line is first formed in the first pressing step, so that a character line can be clearly formed on the surface of a formed article.

According to the pressing method and the pressing device of the present invention, fold pressure is released in the second pressing step, whereby a material becomes flowable between dies. A work is formed by expansion flange forming to form the end part of a formed article under this condition, which can prevent cracks due to material shortage from being generated on a formed article. In addition, a portion other than the end part is press-formed before the end part to be formed by expansion flange forming, which can prevent wrinkles from being generated at a portion adjacent to the end part. Furthermore, in the second pressing step, with maintenance of a condition that a portion of a work is pressed, the remaining portion of the work is formed by expansion flange forming, which can prevent wrinkles from being generated at a portion adjacent to the end part in a formed part.

PREFERRED MODE FOR CARRYING OUT THE INVENTION

Each embodiment of the present invention is described below in more detail with reference to the accompanying drawings.

First Embodiment

Figure 1:
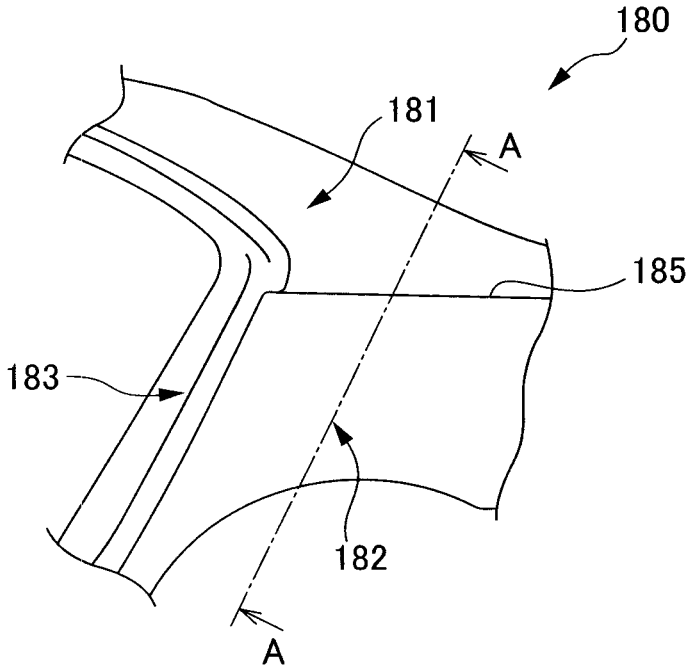
FIG. 1 is a front view illustrating the structure of a vehicle rear side outer panel press-formed by the pressing device and the pressing method according to the first embodiment of the present invention.

FIG. 1 is a front view illustrating the structure of a vehicle rear side outer panel 180 as a formed article press-formed by the pressing device and the pressing method according to the first embodiment of the present invention. The rear side outer panel 180 is formed from one steel sheet, having the approximately flat panel upper part 181 and the approximately flat panel lower part 182, and the flange part 183 with which a door of a vehicle (not shown) engages.

The character line 185 as a ridge line formed by bending a steel sheet is formed on this rear side outer panel 180. Accordingly, the rear side outer panel 180 is divided by this character line 185 into the panel upper part 181 which is the upper side of FIG. 1 and the panel lower part 182 which is the lower side of FIG. 1. The flange part 183 is provided at the panel upper part 181 and the panel lower part 182 at the left side of FIG. 1. This flange part 183 is formed by bending the end part of the steel sheet, extending to the vertical direction of FIG. 1.

Figure 2:
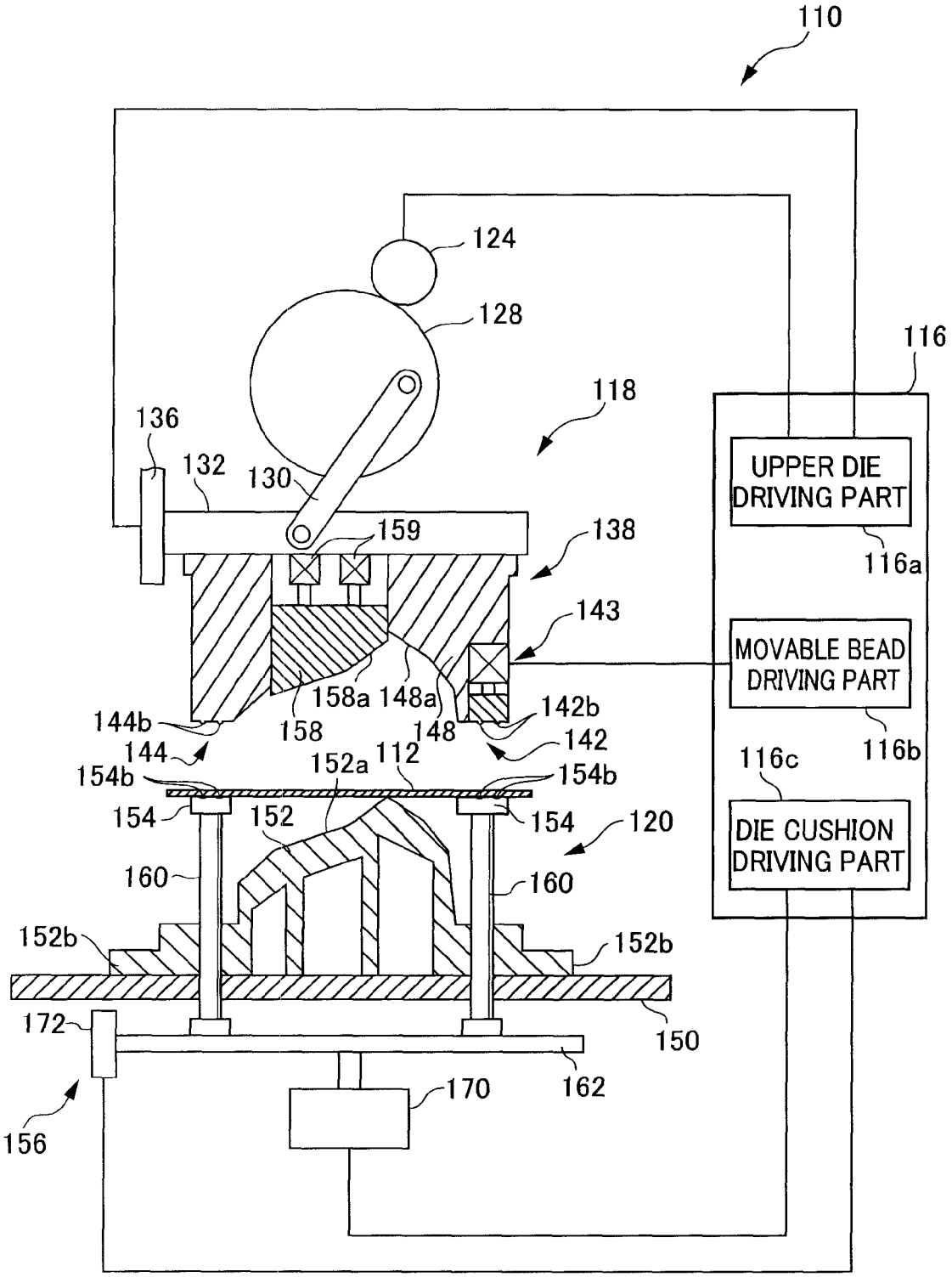
FIG. 2 is a pattern diagram illustrating the structure of a pressing device according to the embodiment of the present invention.

FIG. 2 is a pattern diagram illustrating the partial structure of the pressing device 110 according to the embodiment of the present invention. Specifically, FIG. 2 is an A-A sectional view of the rear side outer panel 180 shown in FIG. 1.

The pressing device 110 has the lower die mechanism 120 having the lower die (second die) 152 placed at the lower side of the steel sheet (work) 112, the upper mechanism (advancing and retrieving mechanism) 118 bringing the upper die (first die) 138 to approach (advance) to and isolate (retrieved)

from the lower die 152, the control part 116 (control means) controlling the lower die mechanism 120 and the upper die mechanism 118.

The upper die mechanism 118 has the servo motor 124, the rotating plate 128 rotarily driven by the servo motor 124 through a reduction gear (not shown), and the connecting rod 130, the top end part of which is swingably pivoted with the side face of the rotating plate 128.

The servo motor 124 is of an AC type for example, having high response and low irregular torque. The shaft rotational position of the servo motor 124 is detected by an encoder (not shown), and then feedback control of the servo motor 124 is conducted based on this detected shaft rotational position.

The upper die mechanism 118 further has the slider 132 pivoted with the bottom end of the connecting rod 130, a guide (not shown) guiding the slider 132 vertically, the first linear sensor 136 detecting the position of the slider 132 to supply a signal to the control part 116, and the upper die 138 provided at the lower face of the slider 132.

The upper die 138 is to place the steel sheet 112 between the upper die 138 and the lower die 152 to conduct press-forming of the steel sheet 112, which is divided by a line as a borderline corresponds to the character line 185 of the rear side outer panel 180 shown in FIG. 1 into divided dies. Specifically, the upper die 138 is divided into the first upper die (first panel die) 148 having the die face 148*a* formed in accordance with the upper region of FIG. 1 (panel upper part 181) from the character line 185, and the second upper die (second panel die) 158 having the die face 158*a* formed in accordance with the lower region of FIG. 1 (the panel lower part 182) from the character line 185.

The first upper die 148 is fixed to the slider 132. Accordingly, the first upper die 148 is lowered together with the slider 132 as the servo motor 124 is driven to lower the slider 132.

The second upper die 158 is provided slidably in a vertical direction to the first upper die 148 fixed to the slider 132. A plurality of the gas springs 159 extending in the sliding direction of the second upper die 158 are installed between the second upper die 158 and the slider 132.

These gas springs 159 bias the second upper die 158 downward at all the time. FIG. 2 illustrates the state in which these gas springs 159 fully extend. Under this condition, the die face 158*a* of the second upper die 158 projects from the die face 148*a* of the first upper die 148. Accordingly, the die face 158*a* of the second upper die 158 abuts the upper face of the steel sheet 112 first after the slider 132 is lowered with the gas springs 159 fully expanding.

In addition, these gas springs 159 shrink from the state of the gas springs 159 fully expanding, resisting this suppress strength, when suppress strength required for press-forming of the steel sheet 112 is applied to the die face 158*a* of the second upper die 158. Furthermore, when the gas springs 159 shrink, the die face 158*a* of the second upper die 158 becomes flush with the die face 148*a* of the first upper die 148 (refer to the following description on FIG. 8).

The ring-like holder is provided around the upper die 138. This ring-like holder is configured by including the first holder 142 placed at the right side of FIG. 2 which is the side of the first upper die 148 and the second holder 144 placed at the left side of FIG. 2 which is the side of the second upper die 158.

The first holder 142 and the second holder 144 is provided with a horizontal plane formed at their top end parts, which are provided at the lower side of FIG. 2 than the positions of the die face 148*a* and the die face 158*a*, respectively. Accordingly, when the slider 132 is lowered, the first holder 142 and the second holder 144 abut the steel sheet 112 before the die face 148*a* and die face 158*a*. In addition, a plurality of the beads 142*b* and 144*b* are provided at the top end parts of the first holder 142 and the second holder 144, respectively.

The first holder 142 and the second holder 144 composing a holder holding the steel sheet 112 between the first holder 142 and the second holder 144, and the below-mentioned blank holder 154 provided in the lower die mechanism 120 to apply fold pressure to the steel sheet 112.

In addition, among these holders, the first holder 142 is provided with the movable bead mechanism 143 (fold pressure adjustment mechanism) vertically moving the bead 142*b* provided at the top end of the first holder 142.

The movable bead mechanism 143 is configured by including a hydraulic cylinder connected with the bead 142*b* and a cylinder driving part: supplying pressure oil to and collecting pressure oil from this cylinder to drive this hydraulic cylinder. This cylinder drive is connected with the control part 116, so that it can move the bead 142*b* vertically. Accordingly, controlling this movable bead mechanism 143 enables the bead 142*b* to project from the top end face of the first holder 142 (refer FIG. 2 and FIGS. 5-7) and to be embedded form the top end face (refer to FIG. 8).

The lower die mechanism 120 has the fixed base 150 to be a base, the lower die 152 provided at the upper part of the fixed base 150, the ring-like blank holder 154 supporting the peripheral part of the steel sheet 112, and the die cushion mechanism 156 lifting and lowering the blank holder 154.

The lower die 152 is to place the steel sheet 112 between the lower die 152 and the upper die 138 including the first upper die 148 and the second upper die 158 to conduct press forming of the steel sheet 112, which is provided with the die face 152*a* at the upper face for abutting the lower face of the steel sheet 112. This die face 152*a* is formed in a shape corresponding to the die face 148*a* of the first upper die 148 and the die face 158*a* of the second upper die 158.

The respective blank holders 154 are provided at the position opposed to the first holder 142 and the second holder 144 of the upper die 138, placing the steel sheet 112 with the first holder 142 and the second holder 144. Accordingly, the end part of the steel sheet 112 is held between the blank holder 154, and the first holder 142 and the second holder 144 to apply fold pressure to this steel sheet 112. This can prevent wrinkles from being generated and shifted when the steel sheet 112 is pressed. In addition, at the top end of this blank holder 154, a plurality of concave parts 154*b* for pushing the steel sheet 112 with the bead 142*b* of the first holder 142 and the bead 144*b* of the second holder 144 are formed.

At this point, as described above, the movable bead mechanism 143 enables the bead 142*b* of the first holder 142 to project from and retroject to the top end face of the first holder 142. Accordingly, the movable bead mechanism 143 projects the bead 142*b* to push the steel sheet 112 into the concave part 154*b* and embeds the bead 142*b* to release the push of the steel sheet 112 into the above-mentioned concave part 154*b*. Therefore, fold pressure applied to the steel sheet 112 can be increased and decreased.

The die cushion mechanism 156 has a plurality of the pins 160 penetrating from the lower side through the fixed base 150 and the attaching part 152*b* of the lower die 152, which are fixed at the lower side of the blank holder 154, the plate 162 connected with the bottom end parts of these pins 160, the hydraulic lifting and lowering mechanism 170 lifting and lowering the plate 162, and the second linear sensor 172 detecting the position of the plate 162 to supply a signal to the control part 116.

The lifting and lowering mechanism 170 is configured by including a hydraulic cylinder (not shown) connected with the plate 162 and a servo equipment (not shown) driving this hydraulic cylinder. This servo equipment is connected with the control part 116, so that the blank holder 154 can press and fold the peripheral part of the steel sheet 112 at an appropriate pressure with the first holder 142 and the second holder 144 of the upper die 138 while the predetermined pressure control is conducted.

The control part 116 has the upper die driving part 116*a* driving the upper die mechanism 118, the movable bead driving part 116*b* driving the movable bead mechanism 143 of the upper die 138, and the die cushion driving part 116*c* driving the die cushion mechanism 156.

The upper die driving part 116*a* conducts drive control of the servo motor 124 while referring to a signal supplied from the encoder connected with the servo motor 124 and the first linear sensor 136, to lift and lower the slider 132. The movable bead driving part 116*b* controls the cylinder driving part of the movable bead mechanism 143 to project the bead 142*b* to and to embed the bead 142*b* from the top end face of the first holder 142. The die cushion driving part 116*c* controls the servo equipment of the lifting and lowering mechanism 170 while referring to a signal supplied from the second linear sensor 172, to lift and lower the blank holder 154.

Figure 3:
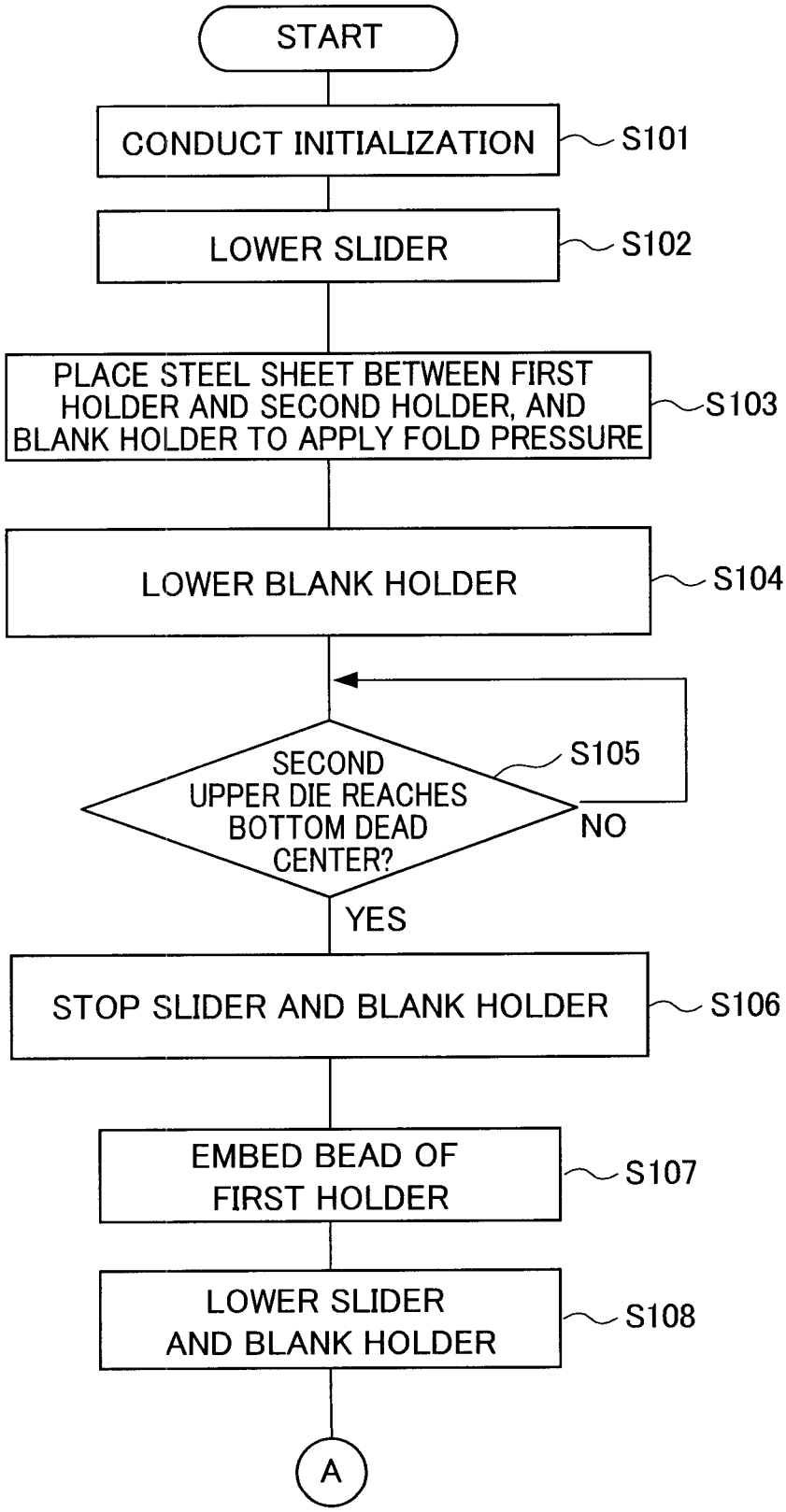
FIG. 3 is a flow chart (I) illustrating the steps of the pressing method according to the embodiment.
Figure 4:
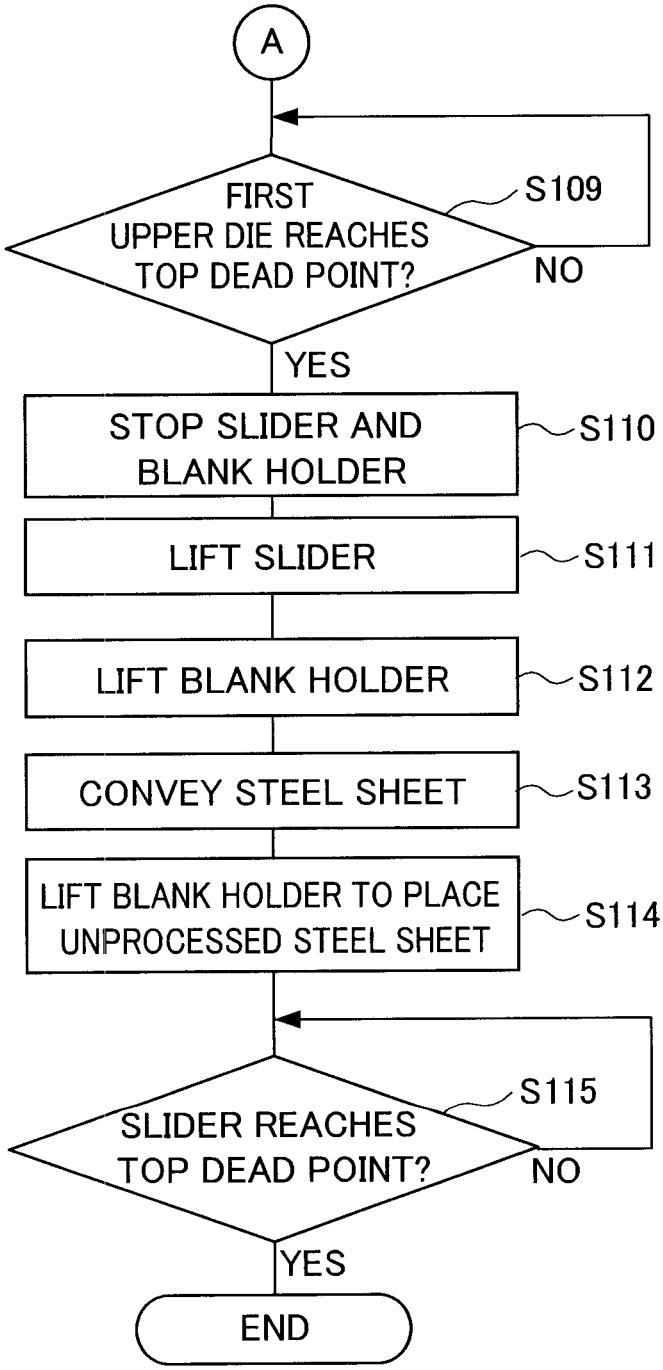
FIG. 4 is a flow chart (II) illustrating the steps of the pressing method according to the embodiment.

Then, the method for press-forming of the steel sheet 112 which is a work by using the pressing device 110 as described above to form the vehicle rear side outer panel 180 as illustrated in FIG. 1 is described below with reference to the flow chart of FIGS. 3 and 4.

First, initialization is conducted in the step S101. Accordingly, the blank holder 154 is lifted to the predetermined position to support the unprocessed steel sheet 112. At this point, the movable bead driving part 116*b* controls the cylinder driving part of the movable bead mechanism 143 to project the bead 142*b* from the top end face of the first holder 142.

In the step S102 (first pressing step), the servo motor 124 is rotarily driven to lower the slider 132 under action of the upper die driving part 116*a*.

Figure 5:
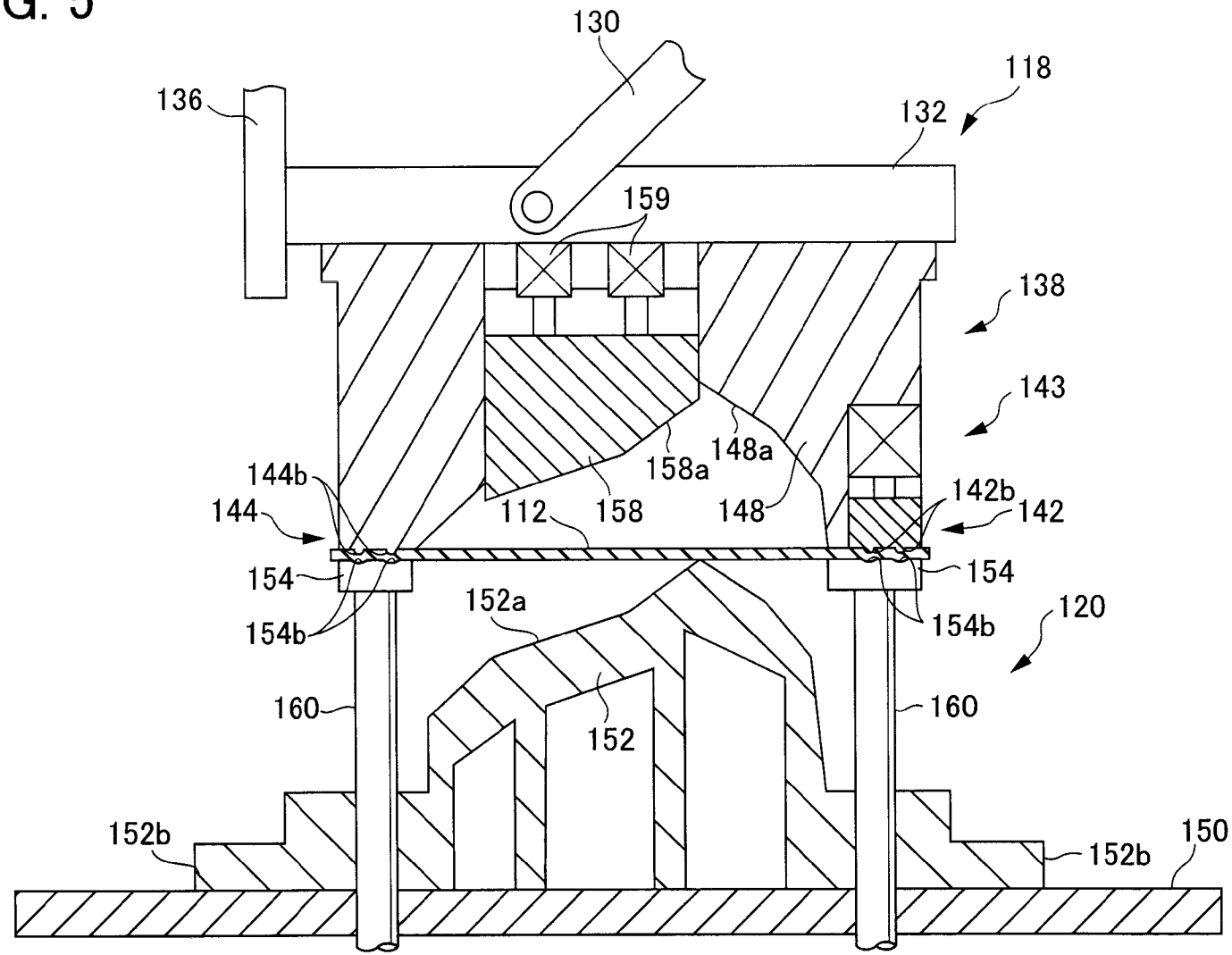
FIG. 5 is a part enlarged section view of the pressing device when a steel sheet is held between the first holder and the second holder, and the blank holder with a bead of the first holder projecting.

When the slider 132 is lowered to some extent, the upper surface of the steel sheet 112 contacts with the first holder 142 and the second holder 144. In the step S103 (first pressing step), both respective ends of the steel sheet 112 are held between the first holder 142 and the second holder 144, and the blank holder 154. Specifically, both respective ends of the steel sheet 112 are pushed into the concave part 154*b* of the blank holder 154 with the bead 142*b* of the first holder 142 and the bead 144*b* of the second holder 144 as shown in FIG. 5. Accordingly, fold pressure is applied to the first holder 142 side and the second holder 144 side of the steel sheet 112.

Figure 9:
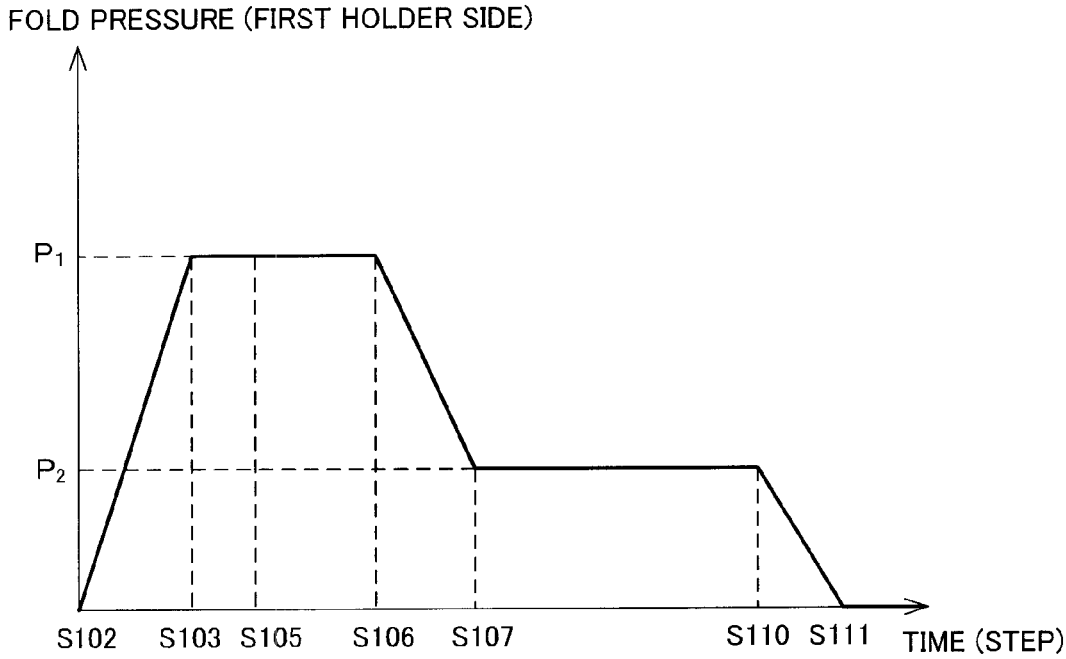
FIG. 9 is a graph chart illustrating the displacement of fold pressure applied to the first holder side of a steel sheet in one cycle.
Figure 10:
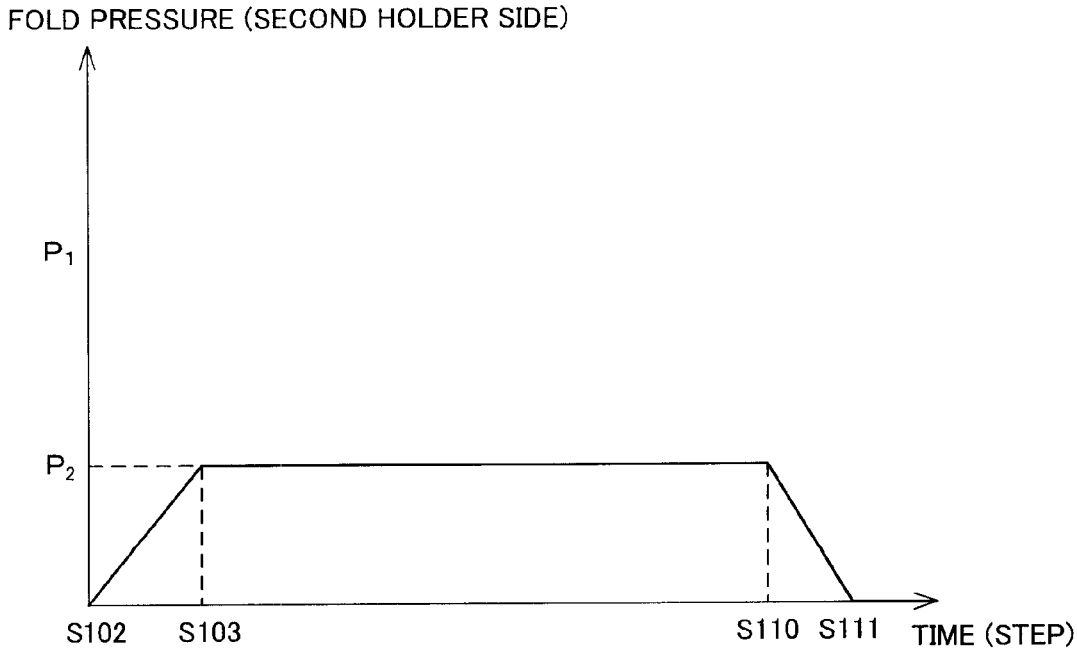
FIG. 10 is a graph chart illustrating the displacement of fold pressure applied to the second holder side of a steel sheet in one cycle.

At this point, fold pressure is applied to the first holder 142 side and the second holder 144 side of the steel sheet 112 at the pressures represented by P1 of FIG. 9 and P2 of FIG. 10, respectively. The bead 142*b* on the first holder 142 side is projected, so that the fold pressure P1 at the first holder side is larger than the fold pressure P2 at the second holder 144 side.

In the step S104 (first pressing step), the servo equipment of the lifting and lowering mechanism 170 is controlled to lower the blank holder 154 under action of the die cushion driving part 116*c*. At this point, the upper die driving part 116*a* and the die cushion driving part 116*c* generates moderate force so that the black holder 154 presses the lower face of the steel sheet 112 in some degree, thereby conducting pressure control to lower the steel sheet 112 being held firmly. Accordingly, the blank holder 154 is pressed by the first holder 142 and the second folder 144 through the steel sheet 112, thereby lowering the steel sheet 112 with fold pressure applied.

Figure 6:
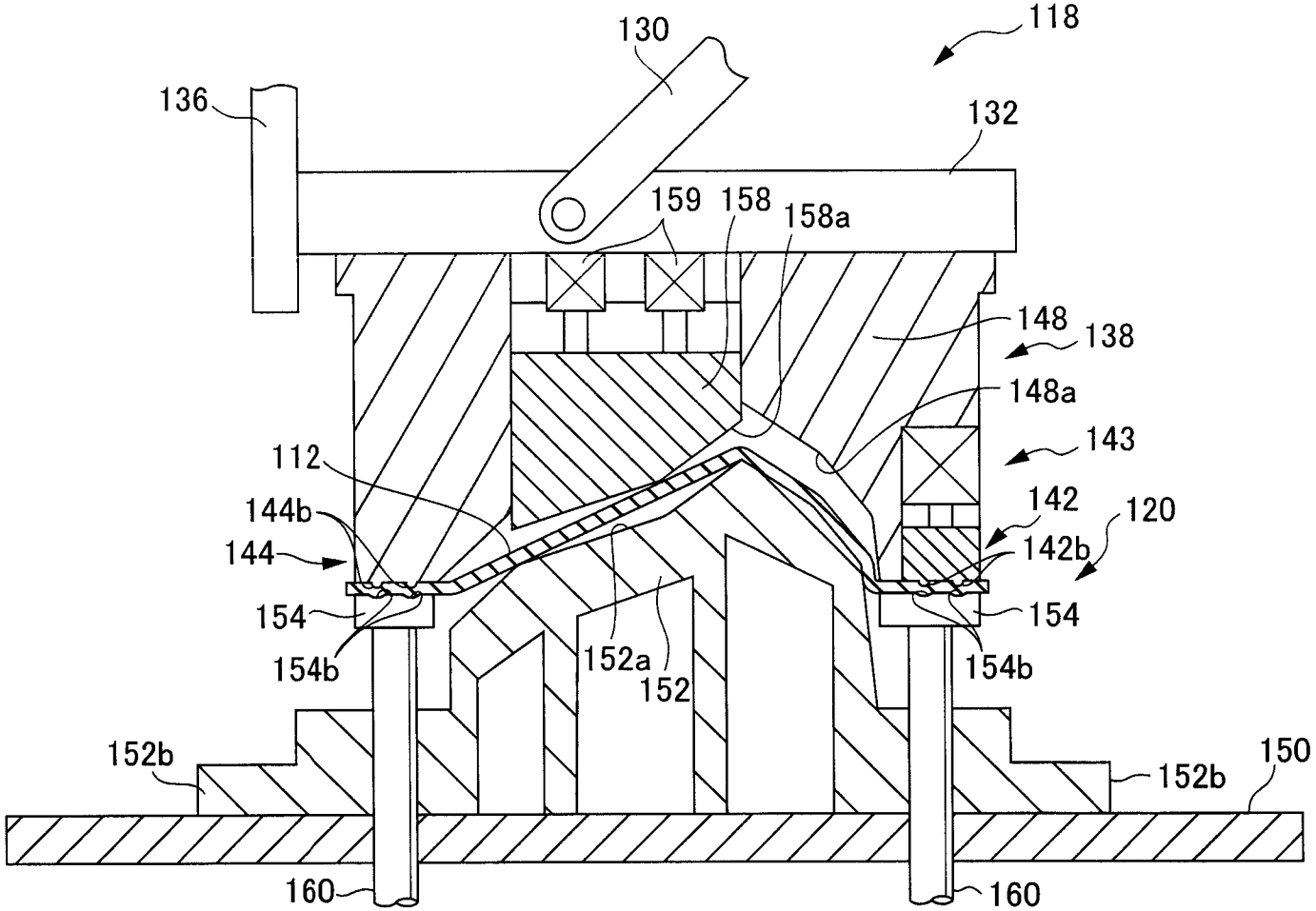
FIG. 6 is a part enlarged section view of a pressing device when the die face of the second upper die contacts with the upper surface of a steel sheet.

When the slider 132 is further lowered, the die face 158*a* of the second upper die 158 contacts with the upper surface of the steel sheet 112 as shown in FIG. 6. In the step S105 (first pressing step), the upper die driving part 116*a* refers to a signal from the first linear sensor 136 to check whether or not the second upper die 158 reaches the bottom dead center. If the second upper die 158 reaches the bottom dead center, the process proceeds to the step S106. Otherwise the second upper 158 continues to be lowered. Hereinafter, the bottom dead center of the second upper die 158 is the position of the second upper die 158 when the steel sheet 112 is placed between the die face 158*a* of the second upper die 158 and the die face 152*a* of the lower die 152 so as not to form any clearance.

Figure 7:
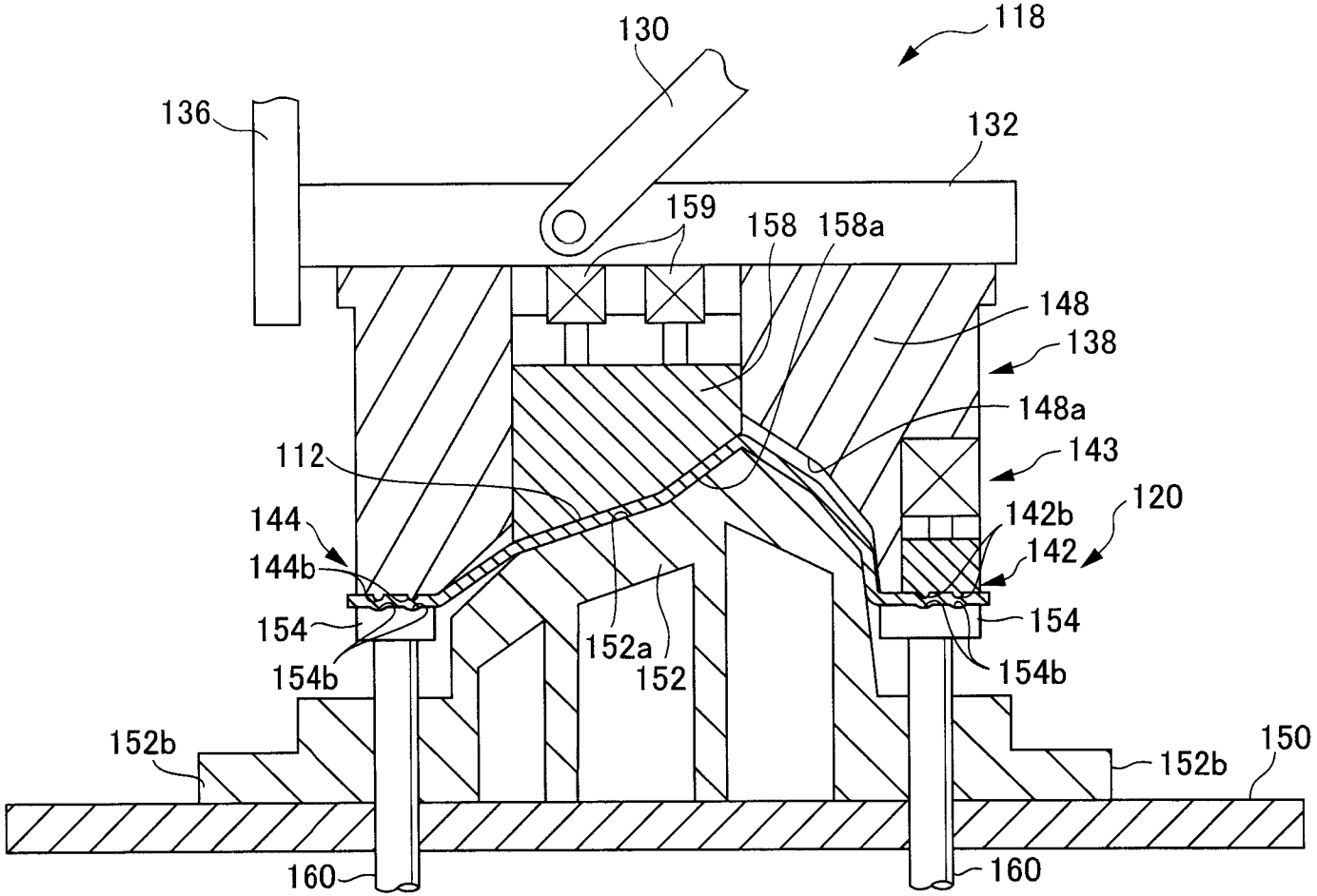
FIG. 7 is a part enlarged section view of a pressing device when the second upper die reaches the bottom dead center.

In the step S106 (first pressing step), the slider 132 and the blank holder 154 stop to be lowered. At this time, the steel sheet 112 is placed between the die face 158*a* of the second upper die 158 and the die face 152*a* of the lower die 152 and then press-formed as shown in FIG. 7. Accordingly, the lower region of FIG. 1 from the character line 185 of the rear side outer panel 180, which is the panel lower part 182, is formed.

In the step S107 (second pressing step), the movable bead driving part 116*b* controls the cylinder driving part of the movable bead mechanism 143 to embed the bead 142*b* from the top end face of the first holder 142. Accordingly, fold pressure applied to the first holder 142 side of the steel sheet 112 is increased to the pressure represented by P2 of FIG. 9 which is smaller than fold pressure (P1 of FIG. 9) applied in the above-mentioned first pressing step.

In the step S108 (second pressing step), the servo motor 124 of upper die mechanism 118 and the servo equipment of the die cushion mechanism 156 is controlled to lower the slider 132 and the blank holder 154 under action of the upper die driving part 116*a* and the die cushion driving part 116*c*.

In the step S109 (second pressing step), the upper die driving part 116*a* refers to a signal from the first linear sensor 136 to check whether or not the first upper die 148 reaches the bottom dead center. If the first upper die 148 reaches the bottom dead center, the process proceeds to the step S110. Otherwise the first upper 148 continues to be lowered. Hereinafter, the bottom dead center of the first upper die is the position of the first upper die 148 when the steel sheet 112 is placed between the die face 148*a* of the first upper die 148 and the die face 152*a* of the lower die 152 so as not to form any clearance. At this point, suppress strength is applied to the second upper die 158, so that the second upper die 158 is pushed back to the side of the slider 132 while shrinking the gas springs 159.

Figure 8:
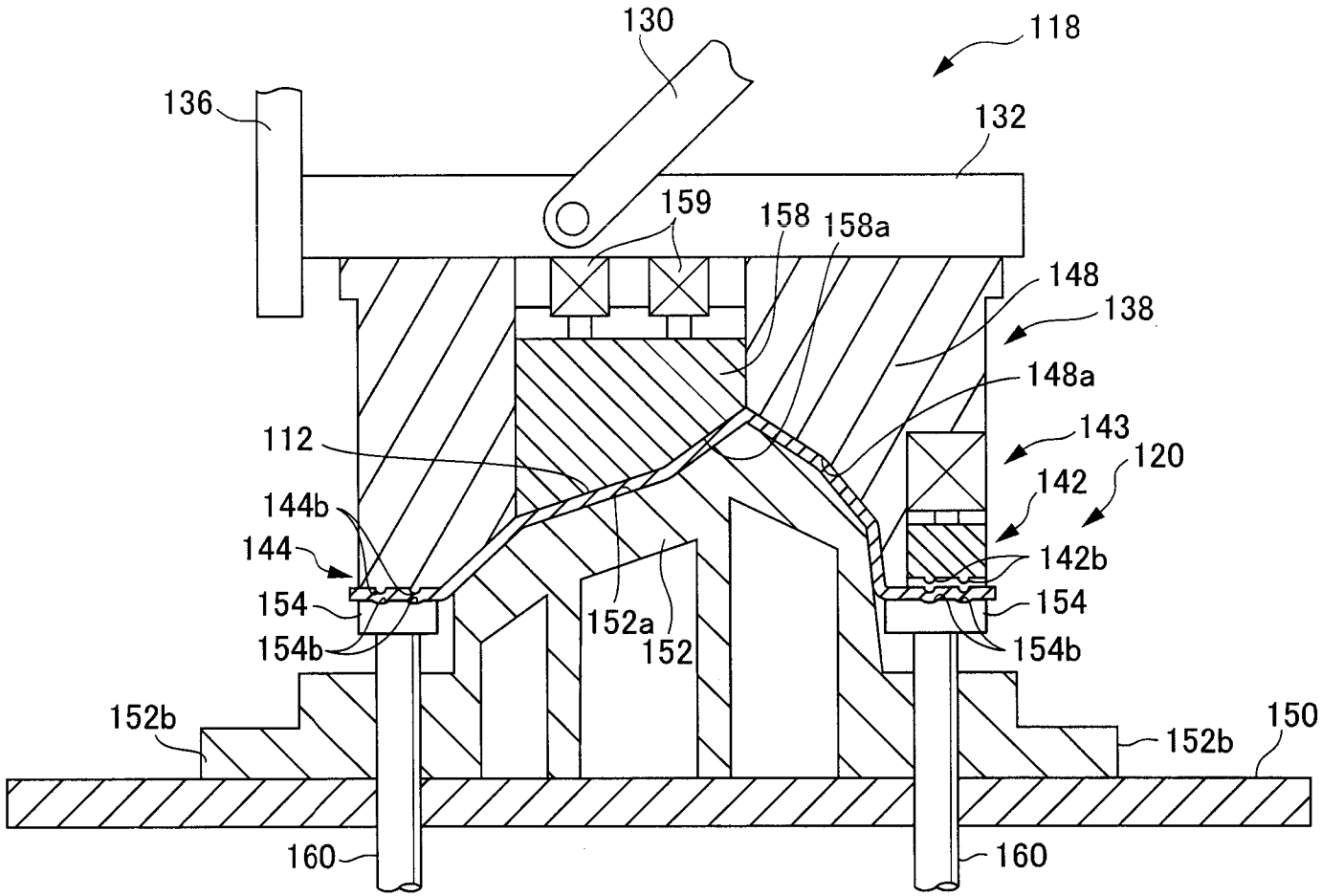
FIG. 8 is a part enlarged section view of a pressing device when the first upper die reaches the bottom dead center.

In the step S110 (second pressing step), the slider 132 and the blank holder 154 stop to be lowered. At this time, the steel sheet 112 is placed between the die face 148*a* of the first upper die 148 and the die face 152*a* of the lower die 152 and then press-formed, and the die face 148*a* of the first upper die 148 is flush with the die face 158*a* of the second upper die 158, as shown in FIG. 8. Accordingly, the upper region of FIG. 1 from the character line 185 of the rear side outer panel 180, which is the panel upper side 181, is formed. At this time, while being press-formed with the first upper die 148, the steel sheet 112 remains to be pressed with the second upper die 158.

In the step S111, the servo motor 124 is rotarily driven to lift the slider 132 under action of the upper die driving part 116*a*. When the slider 132 is lifted, the first holder 142 and the second holder 144 are isolated from the steel sheet 112. Thus, fold pressure applied to the steel sheet 112 is released (refer to FIG. 9).

In the step S112, the servo equipment of the die cushion mechanism 156 is controlled to lift the blank holder 154 to a panel conveyance position under action of the die cushion driving part 116*c*.

In the step S113, the press-formed steel sheet 112 placed on the blank holder 154 is conveyed to the station of the next step by the predetermined conveyance means.

In the step S114, the die cushion driving part 116*c* relifts the blank holder 154 to bring the blank holder 154 to reach the processing stand-by position and then place the unprocessed steel sheet on the predetermined position. In this period, the slider 132 continues to be lifted.

In the step S115, the upper die driving part 116*a* refers to a signal from the first linear sensor 136 to check whether or not the slider 132 reaches the top dead center. If the slider 132 unreaches the top dead center, the slider 132 continues to be lifted. Otherwise the processing of the steel sheet 112 ends.

Hereinbefore, the pressing method using the pressing device 110 is described in one flow chart. However, for example, each driving part of the upper die driving part 116*a*, the movable bead driving part 116*b*, and the die cushion driving part 116*c* may synchronously check each other but operate independently.

According to the present embodiment, the following effect is attained.

(1) According to the pressing device 110 and the pressing method according to the present embodiment, the upper die 138 is divided into the first upper die 148 and the second upper die 158, and then the steel sheet 112 is press-formed by the second upper die 158 and then with the first upper die 148. At this point, the character line 185 is virtually formed by press-forming with the second upper die 158. However, the inflow of a material from the side of the first upper die 148 to the character line 185 portion increases to be larger than that from the side of the second upper panel 158, which may cause the character line 185 to shift. Accordingly, fold pressure to be larger than that applied by the second holder 144 at the side of the second upper die 158 is applied by the first holder 142 at the side of the first upper die 148 to control the inflow of a material from the side of the first upper die 148. Therefore, the inflows of a material from the sides of the first upper die 148 and the second upper die 158 to the character line 185 portion can be almost evenly divided to prevent the character line 185 from shifting.

(2) The movable bead mechanism 143 is provided, so that fold pressure by the first holder 142 can be adjusted easily in proportion to the inflow of a material to the shape of a formed article, particularly the character line 185 portion.

(3) When the steel sheet 112 is press-formed with the first upper die 148, the steel sheet 112 is press-formed with the first upper die 148 while being pressed with the second upper die 158, which can prevent the character line 185 from shifting and also prevent wrinkles from being generated at the portion press-formed by the second upper die 158.

Second Embodiment

Figure 11:
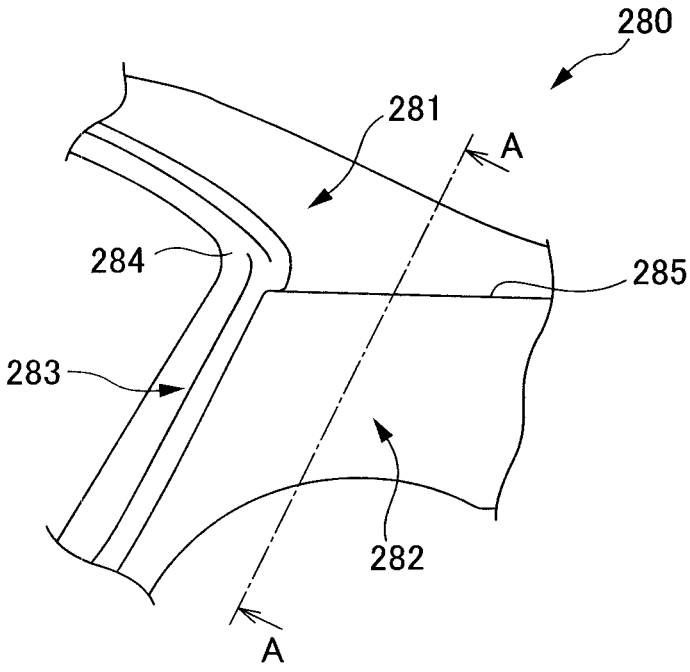
FIG. 11 is a front view illustrating the structure of a rear side outer panel press-formed by the pressing device according to the second embodiment of the present invention.

FIG. 11 is a front view illustrating the structure of a vehicle rear side outer panel 280 press-formed by the pressing device according to the second embodiment of the present invention. The rear side outer panel 280 is formed from one steel sheet, having the approximately flat panel upper part 281 and the approximately panel flat lower part 282 and the flange part 283 with which a door of a vehicle (not shown) engages.

The panel upper part 281 and the panel lower part 282 are divided by the character line 285 as a boundary splitting the upper side and the lower side of FIG. 11. This character line 285 is an important ridge line for the design. The flange part 283 is provided at the left side of FIG. 11 in the panel upper part 281 and the panel lower part 282. This flange part 283 is formed by bending the end part of the steel sheet, extending to vertical direction of FIG. 11. In addition, the inner corner portion adjacent to the panel upper part 281 in this flange part 283 is the bent part (end part) 284 formed by forming the steel sheet by expansion flange forming.

Figure 12:
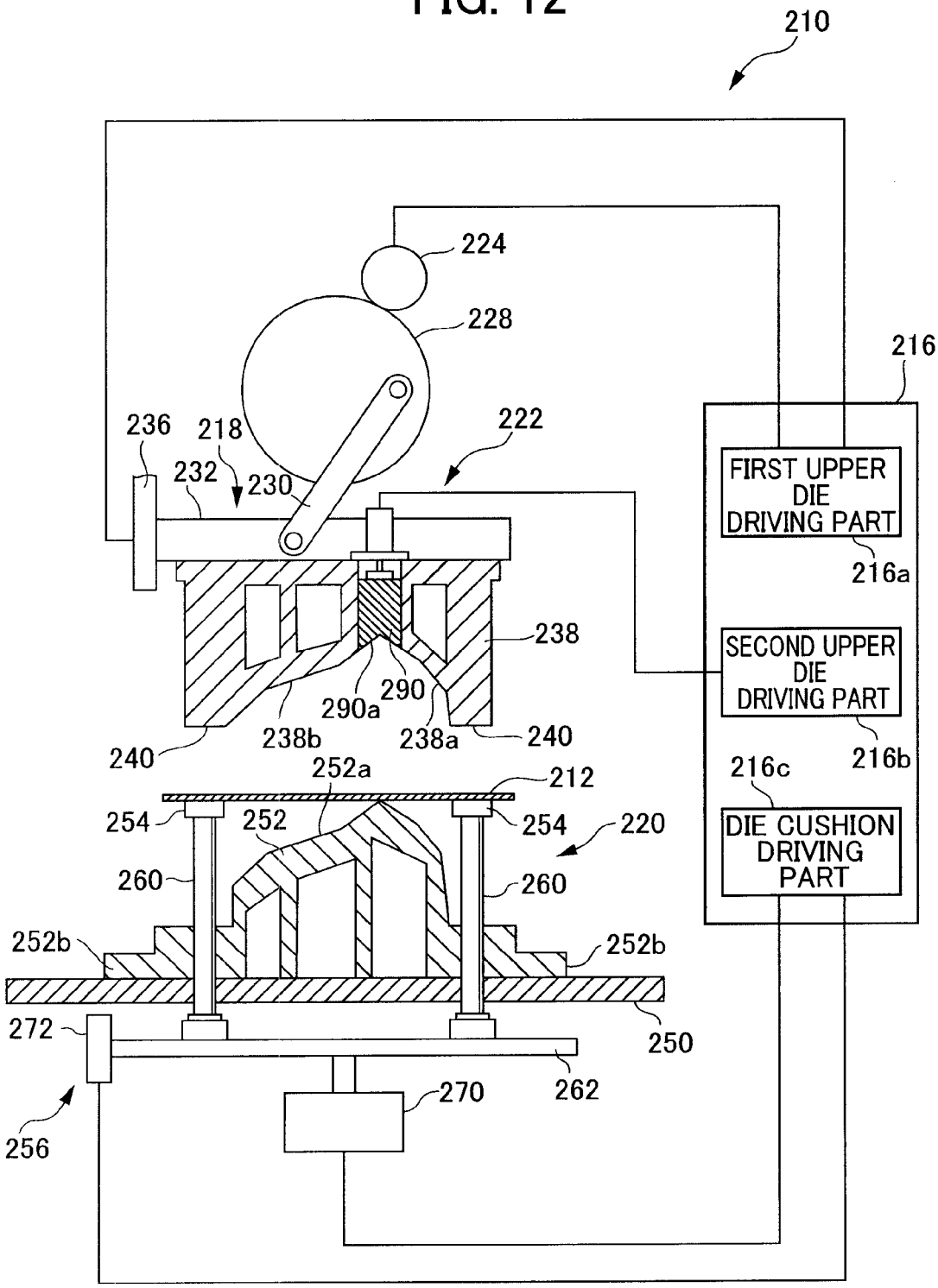
FIG. 12 is a pattern diagram illustrating the structure of a pressing device according to the embodiment.

FIG. 12 is a pattern diagram illustrating the partial structure of the pressing device 210 according to the embodiment of the present invention. Specifically, FIG. 12 is an A-A sectional view of the rear side outer panel 280 shown in FIG. 11.

The pressing device 210 has the lower die mechanism 220 having the lower die (second die) 252 placed at the lower side of the steel sheet (work) 212, the first upper die mechanism (advancing and retrieving mechanism) 218 bringing the first upper die 238 to approach (advance) to and isolate (retrieved) from the lower die 252, the second upper die mechanism 222 (advancing and retrieving mechanism) provided in the first upper die mechanism 218, bringing the second upper die 290 (character line die) to approach to and isolate from the lower die 252, and the control part 216 (control means) controlling the lower die mechanism 220, the first upper die mechanism 218, and the second upper die mechanism 222.

The die face 238*a* and the die face 238*a* of the first upper die 238, and the die face 290*a* of the second upper die 290 in the above-mentioned pressing device 210 composes one forming face. That is, the first upper die 238 and the second upper die 290 have a structure dividing one die. The die face 290*a* of the second upper die 290 is placed over the character line 285 of the rear side outer panel 280.

The first upper die mechanism 218 has the servo motor 224, the rotating plate 228 rotarily driven by the servo motor 224 through a reduction gear (not shown), and the connecting rod 230, the top end part of which is swingably pivoted with the side face of the rotating plate 228.

The servo motor 224 is of an AC type for example, having high response and low irregular torque. The shaft rotational position of the servo motor 224 is detected by an encoder (not shown), and then feedback control of the servo motor 224 is conducted based on this detected shaft rotational position.

The first upper die mechanism 218 further has the slider 232 pivoted with the bottom end of the connecting rod 230, a guide (not shown) guiding the slider 232 vertically, the first linear sensor 236 detecting the position of the slider 232 to supply a signal to the control part 216, and the first upper die 238 provided at the lower face of the slider 232.

The first upper die 238 is to place the steel sheet 212 between the first upper die 238 and the lower die 252 to conduct press-forming of the steel sheet 212, which is provided with the die faces 238*a* and 238*b* at the lower face for abutting the upper face of the steel sheet 212. In addition, the ring-like holder 240 projects to some extent around the first upper die 238. Therefore, the holder 240 abuts the steel sheet 212 before the die faces 238*a* and 238*b*. The top end face of the holder 240 is set to the horizontal.

Figure 13:
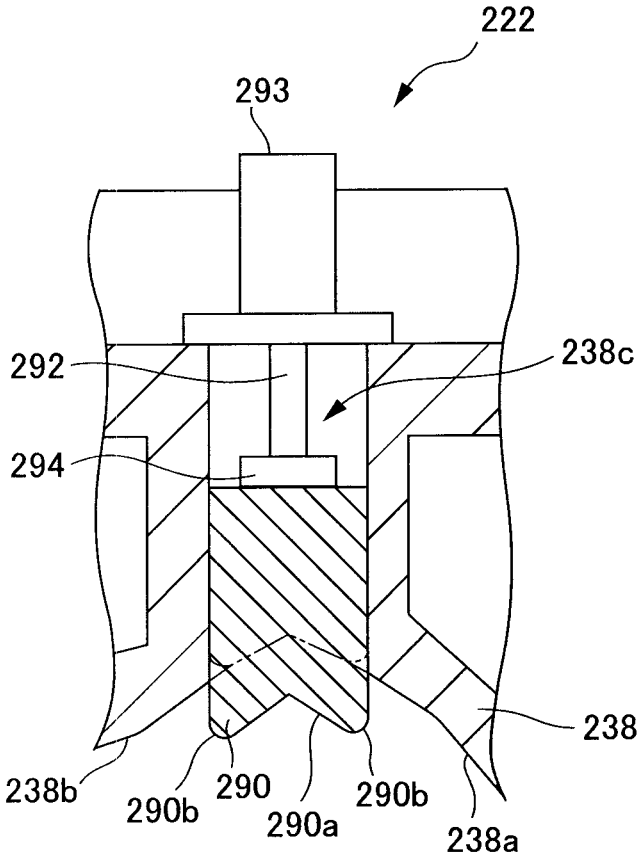
FIG. 13 is a section view of the second upper mechanism of the pressing device according to the embodiment.

FIG. 13 is a sectional view illustrating the structure of the second upper die mechanism 222 provided in the first upper die mechanism 218. As shown in FIG. 13, the second upper die mechanism 222 has the second upper die 290 on which the die face 290*a* is formed, and the actuator 293 projecting the second upper die 290 from the forming face of the first upper die 238 (die face 238*a* and die face 238*b*).

The second upper die 290 engages with the guide hole 238*c* provided on the first upper die 238, which, for example, is movable to the vertical direction of FIG. 13. The chamfer part 290*b* is formed along the periphery of the top end face of the second upper die 290.

The actuator 203 has the driver rod 292 movable to vertical direction of FIG. 13, a cylinder (not shown) connected with the driver rod 292, and a hydraulic motor (not shown) supplying pressure oil to and collecting pressure oil from this cylinder. The actuator 293 pushes this driver rod 292 to the lower side of FIG. 13 to press the second upper die 290, thereby rejecting the die face 290*a* of the second upper die 290 from the forming face of the first upper die 238 (die face 238*a* and die face 238*b*).

The second upper die mechanism 222 further has the servo motor (not shown) driving the hydraulic motor of the actuator 293 rotarily and the second linear sensor 294 detecting the position of the second upper die 290 to supply a signal to the control part 216. The servo motor is connected with the control part 216, so that the portion forming a character line of the steel sheets 212 can be pressed at an appropriate pressure with the die face 252*a* of the lower die 252 and the die face 230*a* of the second upper die 290.

Return to FIG. 12, the lower die mechanism 220 has the fixed base 250 to be a base, the lower die 252 provided at the upper part of the fixed base 250, the ring-like blank holder 254 supporting the peripheral part of the steel sheet 212, and the die cushion mechanism 256 lifting and lowering the blank holder 254.

The lower die 252 is to place the steel sheet 21 between the lower die 252 and the first upper die 238, and the second upper die 290 to conduct press-forming of the steel sheet 212, which is provided with the die face 252*a* at the upper face for abutting the lower face of the steel sheet 212. This die face 252*a* is formed in a shape corresponding to the die faces 238*a* and 238*b* of the first upper die 238, and the die face 290*a* of the second upper die 290.

The blank holder 254 is provided at the position opposed to the holder 240 of the first upper die 238, holding the end part of the steel sheet 212 between the blank holder 254 and the holder 240 in order to prevent wrinkle from being generated, displaced, and the like when the steel sheet 212 is pressed.

The die cushion mechanism 256 has a plurality of the pins 260 penetrating from the lower side through the fixed base 250 and the attaching part 252*b* of the lower die 252, which are fixed at the lower side of the blank holder 254, the plate 262 connected with the bottom end parts of these pins 260, the hydraulic lifting and lowering mechanism 270 lifting and lowering the plate 262, and the third linear sensor 272 detecting the position of the plate 262 to supply a signal to the control part 216.

The lifting and lowering mechanism 270 is configured by including a hydraulic cylinder (not shown) connected with the plate 262 and a servo equipment (not shown) driving this hydraulic cylinder. This servo equipment is connected with the control part 216, so that the blank holder 254 can press and hold the peripheral part of the steel sheet 212 at an appropriate pressure with the holder 240 of the first upper die 238 while the predetermined pressure control is conducted.

The control part 216 has the first upper die driving part 216*a* driving the first upper die mechanism 218, the second upper die driving part 216*b* driving the second upper mechanism 222, and the die cushion driving part 216*c* driving the die cushion mechanism 256.

The first upper die driving part 216*a* conducts drive control of the servo motor 224 while referring to a signal supplied from the encoder connected with the servo motor 224 and the first linear sensor 236, to lift and lower the slider 232. The second upper die driving part 216*b* conducts driving controlling of the actuator 293 while referring to a signal supplied from the second linear sensor 294, to lift and lower the second upper die 290. The die cushion driving part 216*c* controls the servo equipment of the die cushion mechanism 256 while referring to a signal supplied from the third linear sensor 272, to lift and lower the blank holder 254.

Figure 14:
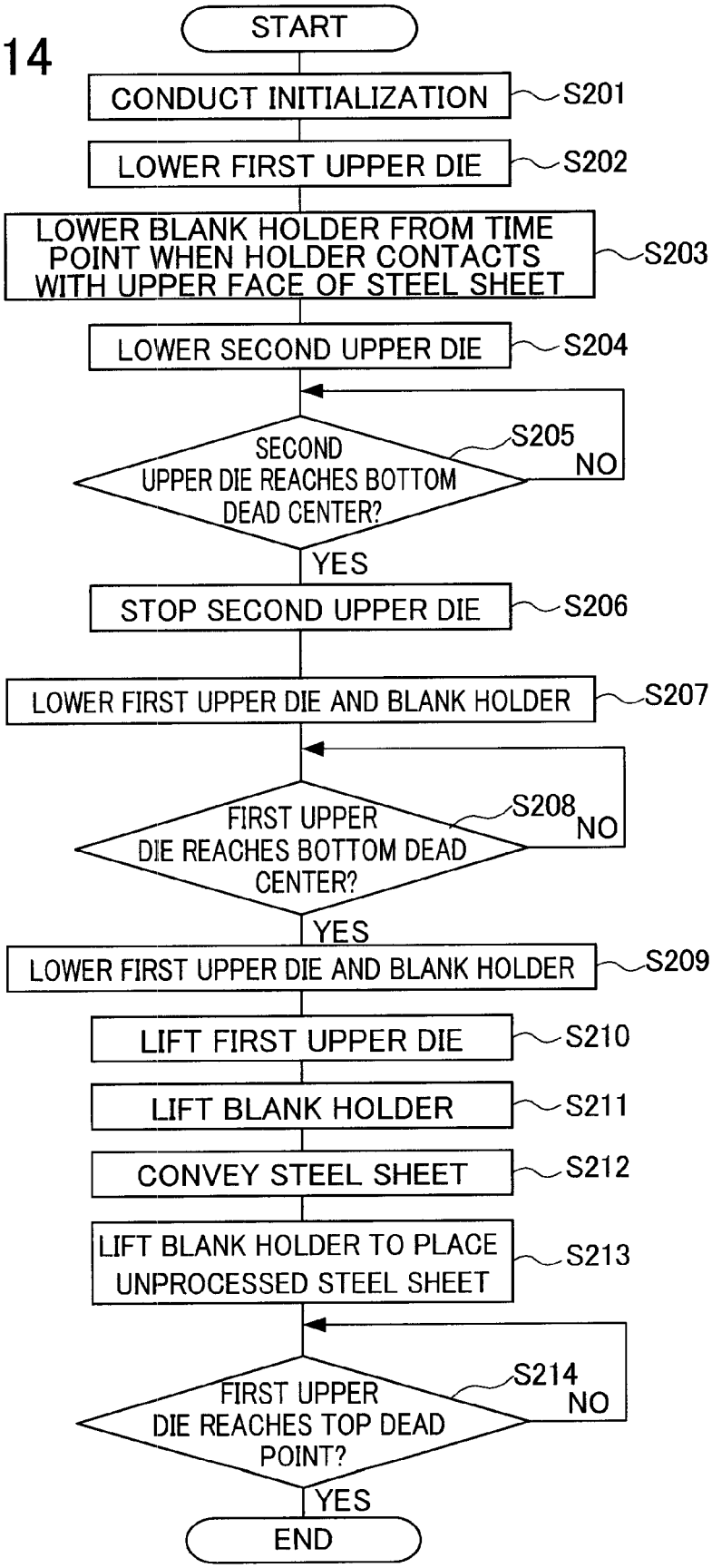
FIG. 14 is a flow chart illustrating the pressing steps of operation of a pressing device according to the embodiment.

Then, the method for pressing the steel sheet 212 which is a work by using the pressing device 210 as described above to form the vehicle rear side outer panel 280 as illustrated in FIG. 11 is described below with reference to the flow chart of FIG. 14.

First, initialization is conducted in the step S201. Accordingly, the blank holder 254 is lifted to the predetermined position to support the unprocessed steel sheet 212. At this point, the die face 290*a* of the second upper die 290 in the second upper die mechanism 222 is flush with the forming face of the first upper die 238 (the die face 238*a* and the die face 238*b*), and then the first upper die 238 is lifted to the top dead center.

In the step S202, the servo motor 224 is rotarily driven to lower the first upper die 238 under action of the first upper die driving part 216*a*.

When the first upper die 238 is lowered to some extent, the holder 240 contacts with the upper face of the steel sheet 212, and then the steel sheet 212 is held between the holder 240 and the blank holder 254. Accordingly, fold pressure is applied to the steel sheet 212. In addition, from this point when the steel sheet 212 is held between the holder 240 and the blank holder 254, and the servo equipment of the die cushion mechanism 256 is controlled to lower the blank holder 254 as well under action of the die cushion driving part 216*c* (Step S203). Thus, even if the first upper die 238 is lowered, fold pressure applied to the steel sheet 212 is maintained appropriately. When the first upper die 238 and the blank holder 254 are lowered to the predetermined position, the first upper die driving part 216*a* and the die cushion driving part 216*c* stop to lower the first upper die 238 and the blank holder 254.

In the step S204, the second upper die driving part 216*b* drives the actuator 293 to lower the second upper die 290, thereby projecting the die face 290*a* of the second upper die 290 from the forming face of the first upper die 238 (the die face 238*a* and the die face 238*b*).

In the step S205, the second upper die driving part 216*b* refers to a signal from the second linear sensor 294 to check whether or not the second upper die 290 reaches the bottom dead center. If the second upper 290 reaches the bottom dead center, the process proceeds to the step S206. Otherwise the second upper 290 continues to be lowered.

Figure 15:
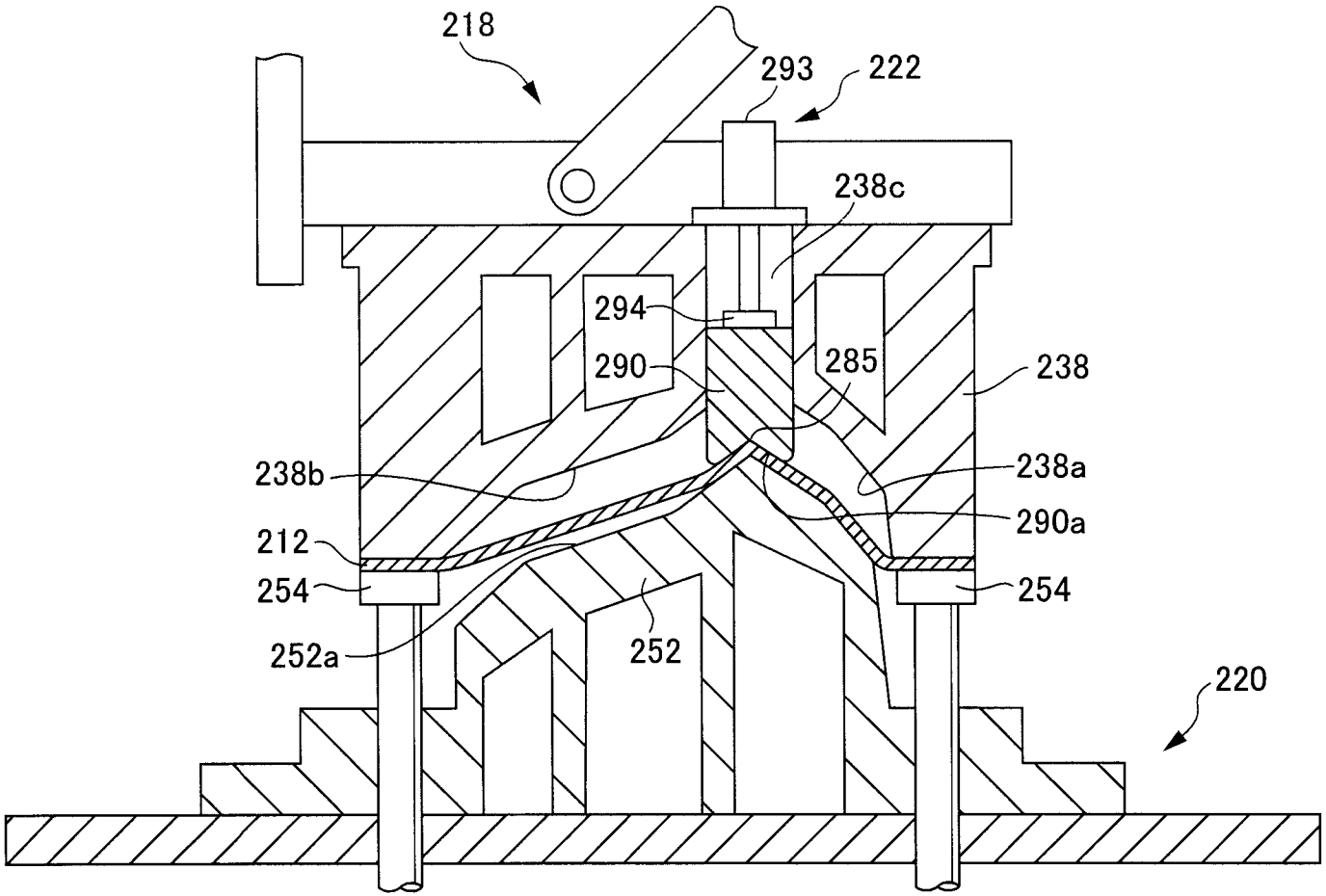
FIG. 15 is a partial enlarged view of the state in which the character line die of the pressing device according to the embodiment is lowered to the bottom dead center.

In the step S206, the second upper die 290 stops to be lowered. At this time, the steel sheet 212 is placed between the die face 290*a* of the second upper die 290 and the die face 252*a* of the lower die 252 and then press-formed as shown in FIG. 15. Accordingly, the character line 285 of the rear side outer panel 280 of FIG. 11 is formed.

In the step S207, the first upper die 238 and the blank holder 254 are lowered under action of the first upper die driving part 216*a* and the die cushion driving part 216*c*. Simultaneously, the second upper die 290 is embedded into the first upper die 238 under action of the second upper die driving part 216*b*. Accordingly, the upper surface of the steel sheet 212 remains to be pressed with the die face 290*a* of the second upper die 290.

In the step S208, the first upper die driving part 216*a* refers to a signal from the first linear sensor 236 to check whether or not the first upper die 238 reaches the bottom dead center. If the first upper die 238 reaches the bottom dead center, the process proceeds to the step S209. Otherwise the first upper die 238 continues to be lowered.

Figure 16:
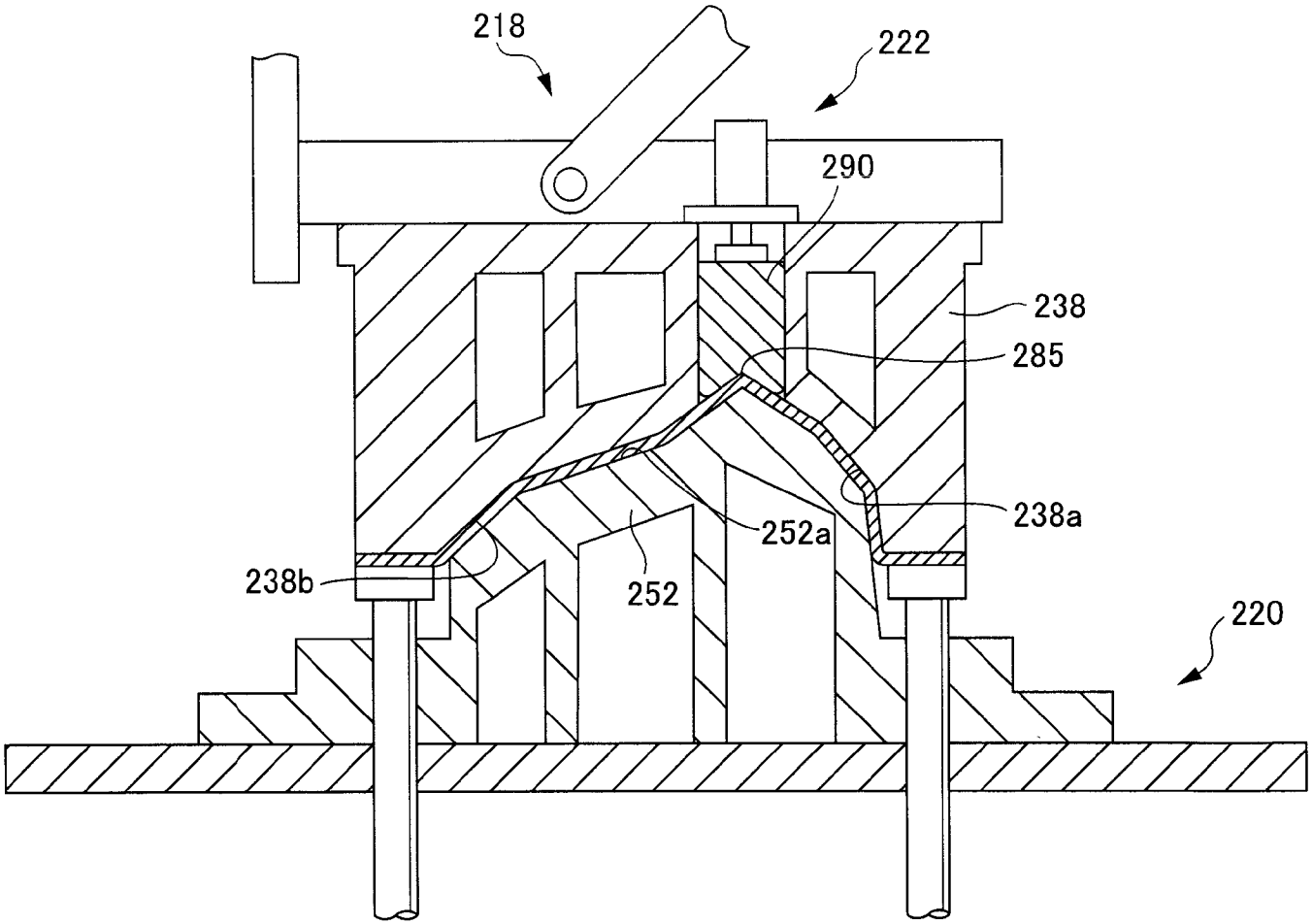
FIG. 16 is a partial enlarged view of the state in which the rest of divided dies of the pressing device according to the embodiment is lowered to the bottom dead center.

In the step S209, the first upper die 238 and the blank holder 254 stop to be lowered. Then, the steel sheet 212 is placed between the forming face (die faces 238*a* and 238*b*) of the first upper die 238 and the die face 252*a* of the lower die 252 and then press-formed as shown in FIG. 16. Accordingly, in the rear side outer panel 280 of FIG. 11, the panel upper part 281, the panel lower side 282, and the flange part 283, which are the remaining portion other than the character line 285 formed in the step S206, are formed.

At this time, the first upper die 238 reaches the bottom dead center, whereby the die face 290*a* of the second upper die 290 is flush with the forming face of the first upper die 238 (die faces 238*a* and 238*b*). In addition, the steel sheet 212 is held between the die face 290*a* of the second upper die 290 and the die face 252*a* of the lower die 252. Therefore, the panel upper part 281, the panel lower side 282, and flange part 283 are formed by press-forming of the reminding portion of the steel sheet 212 while pressure is applied to the portion across the character line 285 of the steel sheet 212.

In the step S210, the servo motor 224 is rotarily driven under action of the first upper die driving part 216*a* to lower the first upper die 238.

In the step S211, the servo equipment of the die cushion mechanism 256 is controlled under action of the die cushion actuator 216*c* to lift the blank holder 254 to the panel conveyance position.

In the step S212, the press-formed steel sheet 212 placed on the blank holder 254 is conveyed to the station of the next step by the predetermined conveyance means.

In the step S213, the die cushion driving part 216*c* relifts the blank holder 254 to bring the blank holder 254 to reach the processing stand-by position and then place the unprocessed steel sheet 212 on the predetermined position. In this period, the first upper die 238 continues to be lifted.

In the step S214, the first upper die driving part 216*a* refers to a signal from the first linear sensor 236 to check whether or not the position of the first upper die 238 reaches the top dead center. If the first upper die 238 unreaches the top dead center, the first upper die 238 continues to be lifted. Otherwise the processing of the steel sheet 212 ends.

Hereinbefore, the pressing method using the pressing device 210 is described in one flow chart. However, for example, each driving part of the first upper die driving part 216*a*, the second upper die driving part 216*b*, and the die cushion driving part 216*c* may synchronously check each other but operate independently.

According to the present embodiment, the following effect is attained.

(4) En the first pressing step, the second upper die 290 is lowered, and then the steel sheet 212 is press-formed with the second upper die 290 and the lower die 252 to form the character line 285. Then, in the second pressing step, the first upper die 238 is lowered, and the remaining portion of the steel sheet 212 is press-formed with the first upper die 238 and the lower die 252 to form the panel upper part 281, the panel lower part 282, and the flange part 283. Accordingly, the character line 285 is first formed with the second upper die 290 and the lower die 252, so that the character line 285 can be clearly formed on the rear side outer panel 280.

(5) In the second pressing step, the steel sheet 212 is press-formed with the first upper die 238 and the lower die 252 with maintenance of a condition that a remaining portion of the steel sheet 212 is pressed with the second upper die 290 and the lower die 252. This can prevent a material from flowing from both sides of the character line 285, and also reliably prevent the position of the character line 285 from shifting.

Third Embodiment

Figure 17:
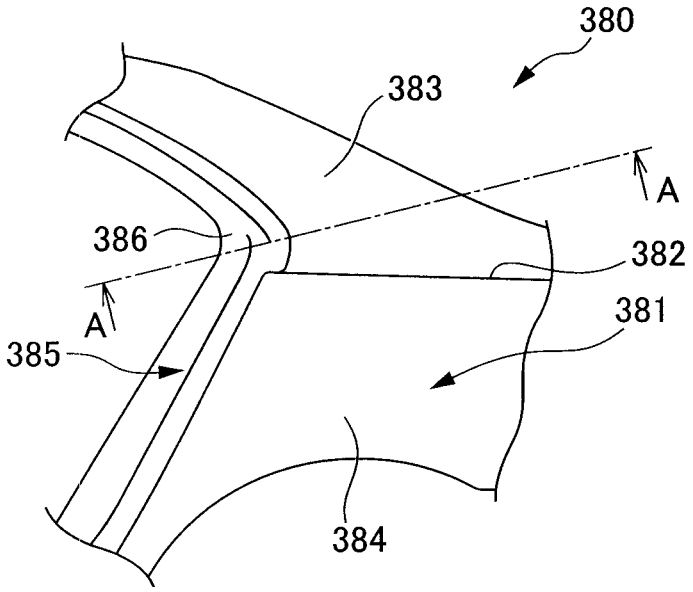
FIG. 17 is a front view illustrating the structure of a vehicle rear side outer panel press-formed by the pressing device according to the third embodiment of the present invention.

FIG. 17 is a front view illustrating the structure of a vehicle rear side outer panel 380 press-formed by the pressing device according to the third embodiment of the present invention. The rear side outer panel 380 is formed from one steel sheet, having the approximately flat panel main body 381 and the flange part 385 with which a door of a vehicle (not shown) engages. The panel main body 381 is divided into the upper side and the lower side of FIG. 17 as the panel upper part 383 and the panel lower part 384 respectively, by the character line 382 as a boundary which is formed by bending the steel sheet.

The flange part 385 is provided at the left side of FIG. 17 in the panel upper part 383 and the panel lower part 384. This flange part 385 is formed by bending the end part of the steel sheet, extending to the vertical direction of FIG. 17. In addition, the inner corner portion adjacent to the panel upper part 383 in this flange part 385 is the bent part 386 (end part) formed by forming the steel sheet by expansion flange forming.

Figure 18:
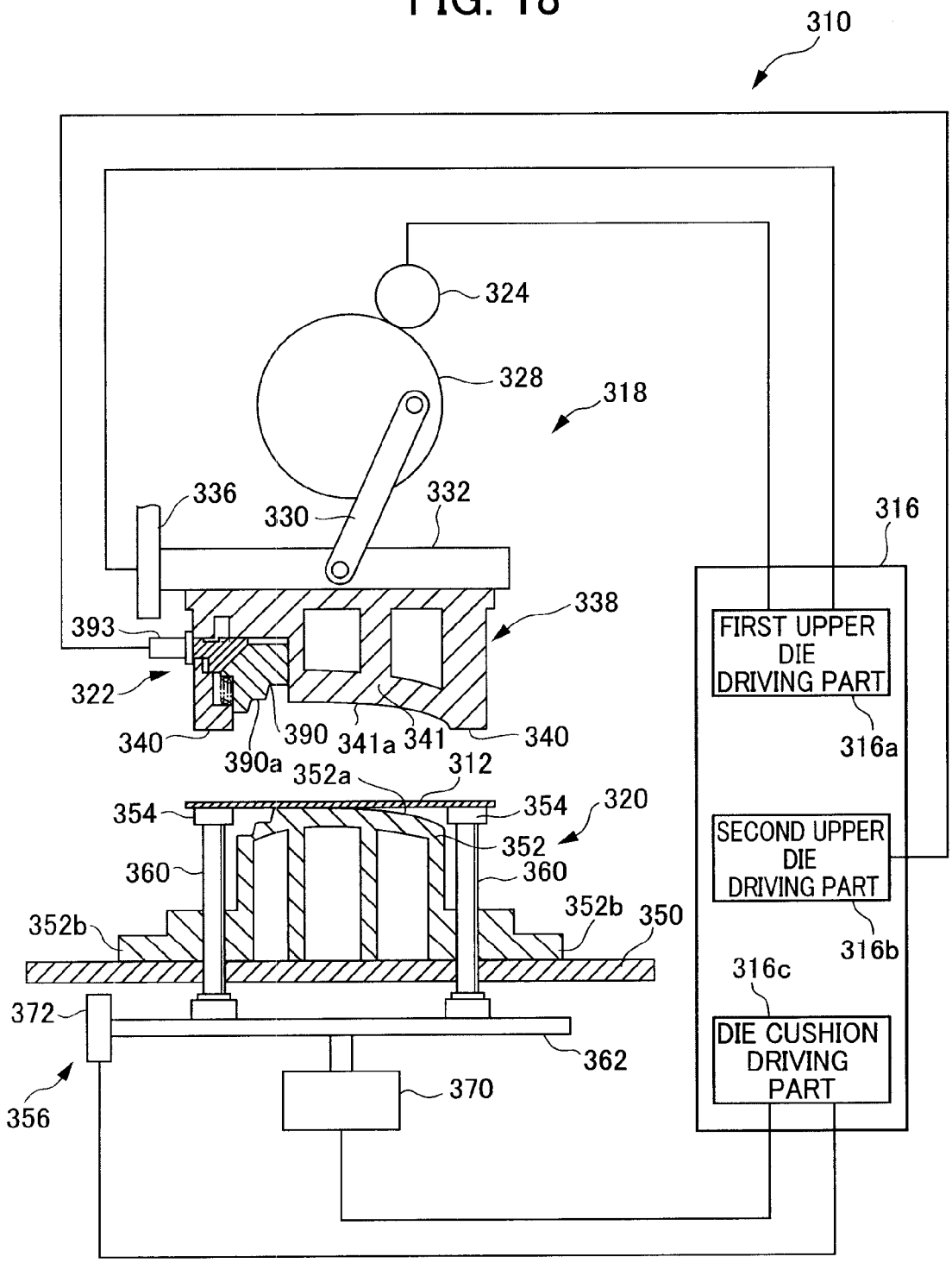
FIG. 18 is a pattern diagram illustrating the structure of a pressing device according to the embodiment.

FIG. 18 is a pattern diagram illustrating the partial structure of the pressing device 310 according to the embodiment of the present invention. Specifically, FIG. 18 is an A-A sectional view of the rear side outer panel 380 shown in FIG. 17.

The pressing device 310 has the lower die mechanism 320 having the lower die (second die) 352 placed at the lower side of the steel sheet (work) 312, the first upper die mechanism (advancing and retrieving mechanism) 318 bringing the first upper die (first form) 338 to approach (advance) to and isolate (retrieved) from the lower die 352, the second upper die mechanism 322 provided in the first upper die 338, bringing the second upper die 390 to approach to and isolate from the lower die 352, and the control part 316 (control means) controlling the lower die mechanism 320, the first upper die mechanism 318, and the second upper die mechanism 322.

The die faces of the first upper die 338 and the second upper die 390 in the above-mentioned pressing device 310 are formed in accordance with the panel main body 381 and the flange part 385 on the rear side outer panel 380, respectively. Thus, the die faces of the first upper die 338 and the second upper die 390 compose one forming face.

The first upper die mechanism 318 has the servo motor 324, the rotating plate 328 rotarily driven by the servo motor 324 through a reduction gear (not shown), and the connecting rod 330, the top end part of which is swingably pivoted with the side face of the rotating plate 328.

The servo motor 324 is of an AC type for example, having high response and low irregular torque. The shaft rotational position of the servo motor 324 is detected by an encoder (not shown), and then feedback control of the servo motor 324 is conducted based on this detected shaft rotational position.

The first upper die mechanism 318 further has the slider 332 pivoted with the bottom end of the connecting rod 330, a guide (not shown) guiding the slider 332 vertically, the first linear sensor 336 detecting the position of the slider 332 to supply a signal to the control part 316, and the first upper die 338 provided at the lower face of the slider 332.

The first upper die 338 has the fixed upper die 341 fixed to the slider 332 and the ring-like holder 340 provided around this fixed upper die 341.

The fixed upper die 341 is to place the steel sheet 312 between the fixed upper die and the lower die 352 to conduct press-forming of the steel sheet 312, which is provided with the die face 341*a* at the lower face for abutting the upper face of the steel sheet 312. In addition, the holder 340 is provided, projecting from the die face 341*a* downward, which abuts the steel sheet 312 before the die face 341*a*. The top end face of the holder 340 is set to the horizontal.

Figure 19:
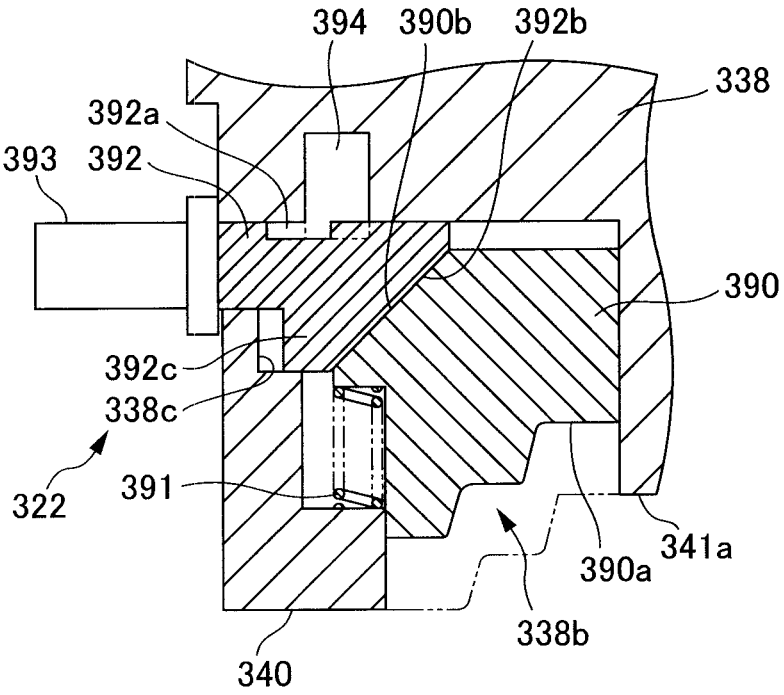
FIG. 19 is a sectional view illustrating the structure of the second upper die mechanism.

The first upper die 338 is provided with a movable upper die mechanism (not shown) advancing the movable upper die (not shown) to and retrieving the movable upper die (not shown) from the lower die 352, which is not shown in figures. In addition, this movable upper die mechanism can embed the die face of a movable upper die from the die face 341*a* of the fixed upper die 341 and bring the die face of the movable upper die to be flush with the die face 341*a*, according to a structure nearly same as that of the second upper die mechanism 322 described in detail with reference to FIG. 19. These die faces of the fixed upper die 341 and the movable upper die are formed in accordance with the panel upper part 383 and the panel lower part 384 on the panel main body 381, respectively FIG. 19 is a sectional view illustrating the structure of the second upper die mechanism 322 provided at the first upper die 338. As shown in FIG. 19, the second upper die mechanism 322 has the second upper die 390 at the top end side of which the die face 390*a* is formed, the spring 391 biasing the second upper die 390 in the direction of embedding the second upper die 390 further than the die face 341*a* of the fixed upper die 341, the actuator 393 bringing the die face 390*a* of the second upper die 390 being flush with the die face 341*a* of the fixed upper die 341, and the mechanism lock 394 locking the second upper die 390 when the die face 390*a* is flush with the die face 341*a*.

The second upper die 390 engages with the guide hole 338*b* provided on the first upper die 338, which, for example, is movable to the vertical direction of FIG. 19. The inclined face 390*b* is formed at the bottom end side of the second upper die 390.

The actuator 393 is provided with the driver rod 392 capable of moving to the horizontal direction of FIG. 19, and the inclined face 392*b* sliding on the inclined face 390*b* of the second upper die 390 is formed on the top end side of the driver rod 392. The actuator 393 pushes this driver rod 392 to the right direction of FIG. 19 to press the inclined face 390*b* of the second upper die 390, thereby projecting the second upper die 390 to the lower side of FIG. 19. Accordingly, the die face 390*a* of the second upper die 390 is flushing with the die face 341*a* of the fixed upper die 341. In the case in which the die face 341*a* has a curved surface, the die face 390*a* and the die face 341*a* have the same curved surface.

The mechanism lock 394 moves in the orthogonal direction (vertical direction of FIG. 19) to the direction to which the driver rod 392 moves, under action of a predetermined extrusion actuator (not shown). The notch part 392*a* is formed on the driver rod 392, and this mechanism lock 394 engages with the notch part 392*a* of the projected driver rod 392, thereby locking the driver rod 392.

In the above-mentioned second upper die mechanism 322, the die face 390*a* of the second upper die 390 is flush with the die face 341*a* of the fixed upper die 341 in following steps. Accordingly, the actuator 393 projects the driver rod 392 to the right direction of FIG. 19. Then, this driver rod 392 presses the inclined face 390*b* of the second upper die 390 so as to resist the elastic force of the spring 391, thereby projecting the second upper die 390 to the lower side of FIG. 19. When the die face 390*a* of the second upper die 390 is flush with the die face 341*a* of the fixed upper die 341, the notch part 392*a* of the driver rod 392 is located immediately below the mechanism lock 394 of FIG. 19. Thus, the mechanism lock 394 is advanced to engage the top end of the mechanism lock 394 with the notch part 392*a* of the driver rod 392. Therefore, the second upper die 390 is locked in the state in which the die face 390*a* is flush with the die face 341*a* of the fixed upper die 341.

In addition, in the above-mentioned second upper die mechanism 322, the die face 390*a* of the second upper die 390 is embedded from the die face 341*a* of the fixed upper die 341 in following steps. Accordingly, the lock by the mechanism lock 394 and the bias of the driver rod 392 by the actuator 393 are released. Then, the second upper die 390 receives force in the direction of being retrieved to the guide hole 338*b* by the elastic force of the spring 391 to press the driver rod 392 to the left side of FIG. 19. The driver rod 392 moves until the convex part 392*c* provided at the top end side abuts the difference part 338*c* formed at the first upper die 338. Therefore, the die face 390*a* of the second upper die 390 is embedded from the die face 341*a* of the fixed upper die 341.

Return to FIG. 18, the lower die mechanism 320 has the fixed base 350 to be a base, the lower die 352 provided at the upper part of the fixed base 350, the ring-like blank holder 354 supporting the peripheral part of the steel sheet 312, and the die cushion mechanism 356 lifting and lowering the blank holder 354.

The lower die 352 is placed between the lower die 352, and the second upper die 390 and a movable upper die (not shown) to conducting press-forming of the steel sheet 312. The die face 352*a* for abutting the lower face of the steel sheet 312 is provided at the upper face. This die face 352*a* is formed in a shape corresponding to the die face 341*a* of the fixed upper die 341, the die face 390*a* of the second upper die 390, and the die face of a movable upper die (not shown).

The blank holder 354 is provided at the position opposed to the holder 340 of the first upper die 338. The end part of the steel sheet 312 is held between the blank holder 354 and the holder 340 in order to prevent wrinkles from being generated, displaced, and so on when the steel sheet 312 is pressed.

The die cushion mechanism 356 has a plurality of the pins 360 penetrating from the lower side through the fixed base 350 and the attaching part 352*b* of the lower die 352, which are fixed at the lower side of the blank holder 354, the plate 362 connected with the bottom end parts of these pins 360, the hydraulic lifting and lowering mechanism 370 lifting and lowering the plate 362, and the second linear sensor 372 detecting the position of the plate 362 to supply a signal to the control part 316.

The lifting and lowering mechanism 370 is configured by including a hydraulic cylinder (not shown) connected with the plate 362 and a servo equipment (not shown) driving this hydraulic cylinder. The servo equipment is connected with the control part 316, so that the blank holder 354 can press and hold the peripheral part of the steel sheet 312 at an appropriate pressure with the holder 340 of the first upper die 338 while the predetermined pressure control is conducted.

The control part 316 has the first upper die driving part 316*a* driving the first upper die mechanism 318, the second upper die driving part 316*b* driving the second upper mechanism 322, and the die cushion driving part 316*c* driving the die cushion mechanism 356.

The second upper die driving part 316*b* conducts driving control of the actuator 393 and the mechanism lock 394 to project the second upper die 390 and to lock the second upper die 390, respectively. The first upper die driving part 316*a* conducts drive control of the servo motor 324 while referring to a signal supplied from the encoder connected with the servo motor 324 and the first linear sensor 336, to lift and lower the slider 332 together with the first upper die 338. In addition, the first upper die driving part 316*a* is connected with a movable upper die mechanism (not shown), controlling a movable upper die in the same way as the above-mentioned second upper die driving part 316*b*. The die cushion driving part 316*c* controls the servo equipment of the die cushion mechanism 356 while referring to a signal supplied from the second linear sensor 372, to lift and lower the blank holder 354.

Figure 20:
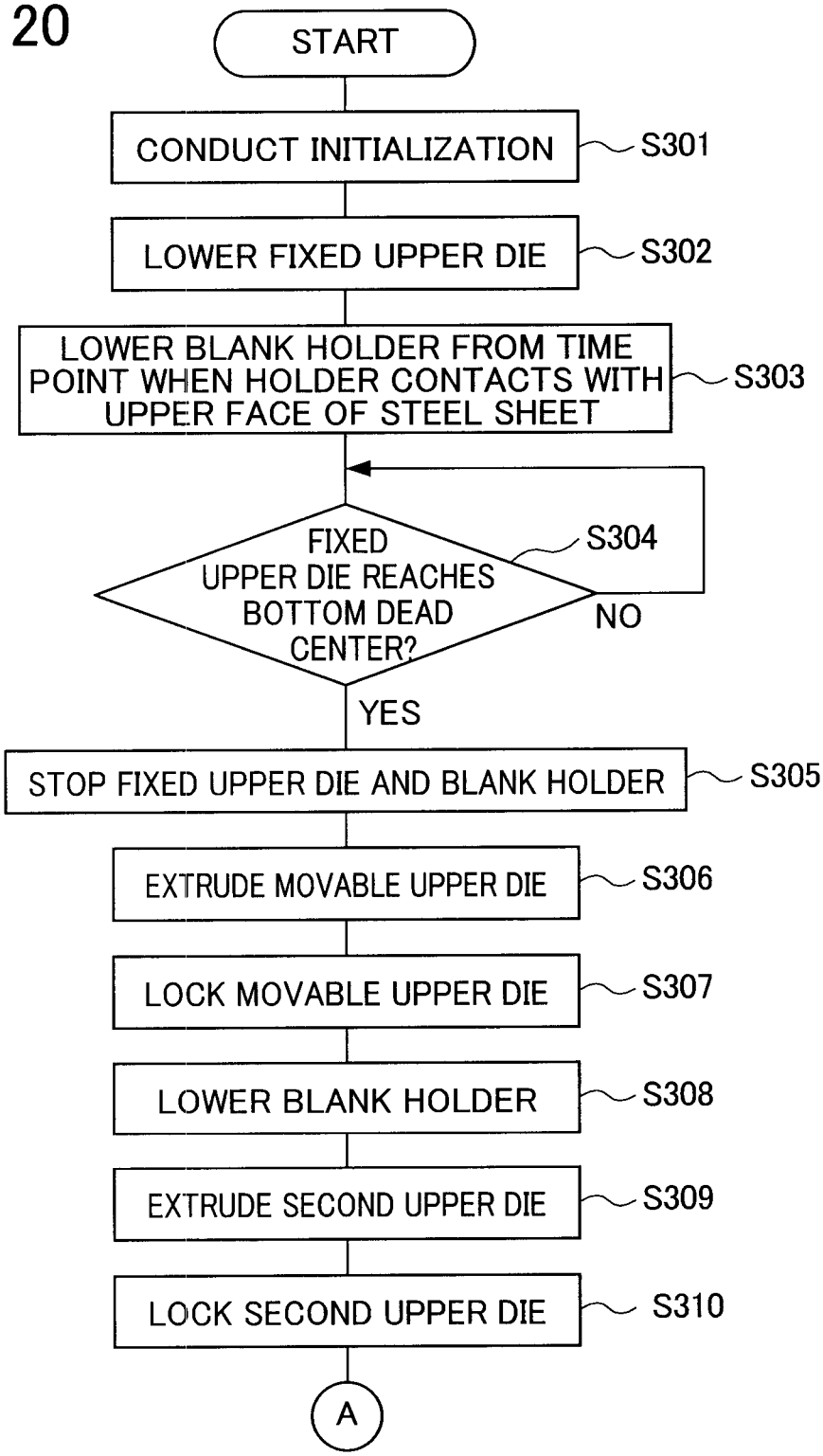
FIG. 20 is a flow chart (I) illustrating the steps of the pressing method according to the embodiment.
Figure 21:
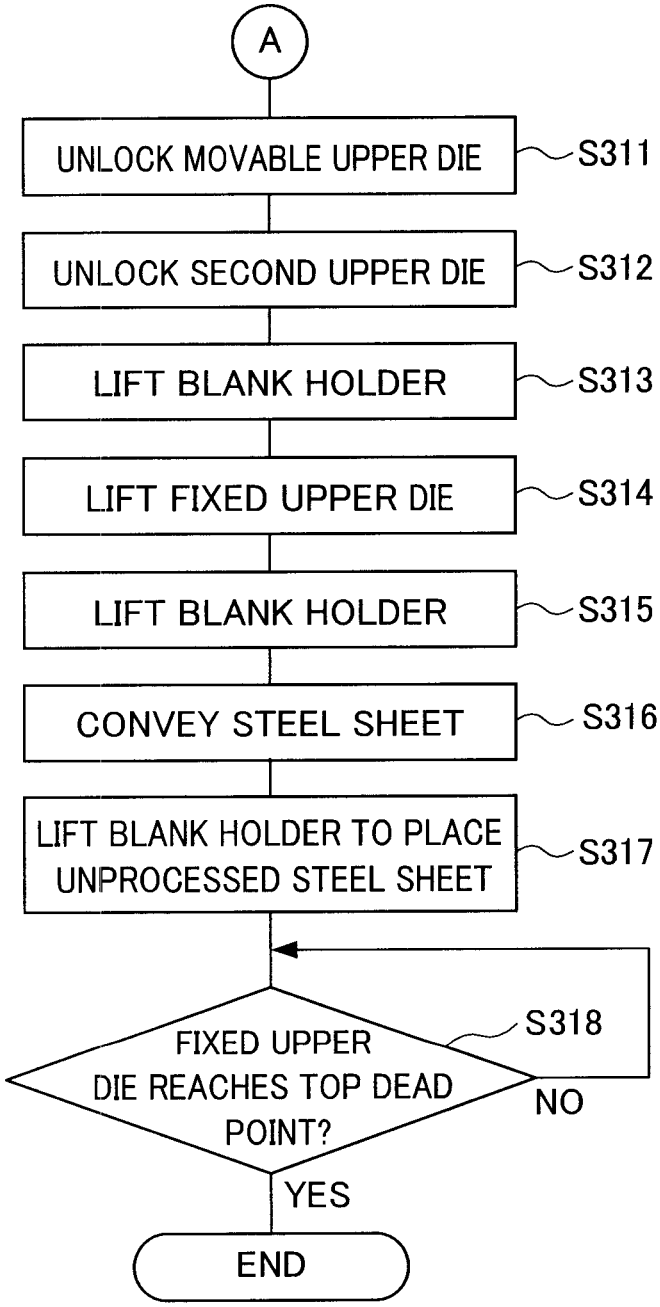
FIG. 21 is a flow chart (II) illustrating the steps of the pressing method according to the embodiment.

Then, the method for pressing the steel sheet 312 which is a work by using the pressing device 310 as described above to form the vehicle rear side outer panel 380 as illustrated in FIG. 17 is described below with reference to the flow chart of FIGS. 20 and 21.

Initialization is first conducted in the step S301. Accordingly, the blank holder 354 is lifted to the predetermined position to support the unprocessed steel sheet 312. At this point, the second upper die 390 of the second upper die mechanism 322 and a movable upper die of the first upper die 338 are embedded form the die face 341*a* of the fixed upper die 341 of the first upper die 338, and then the fixed upper die 341 lifts to the top dead center.

In the step S302 (first pressing step), the servo motor 324 is rotarily driven to lower the fixed upper die 341 under action of the first upper die driving part 316*a*.

When the fixed upper die 341 is lowered to some extent, the holder 340 contacts with the upper face of the steel sheet 312, and then the steel sheet 312 is held between the holder 340 and the blank holder 354. Accordingly, fold pressure is applied to the steel sheet 312. In addition, from this point when the steel sheet 312 is held between the holder 340 and the blank holder 354, the blank holder 354 is lowered under action of the die cushion driving part 316*c* (Step S303).

At this point, the first upper die driving part 316*a* and the die cushion driving part 316*c* generates moderate force so that the black holder 354 presses the lower face of the steel sheet 312 in some degree, thereby conducting pressure control to lower the steel sheet 312 being held firmly. Accordingly, the blank holder 354 is pressed by the holder 340 through the steel sheet 312, thereby applying moderate pressure to the steel sheet 312 to be depressed. Therefore, the steel sheet 312 is lowered with fold pressure applied.

In the step S304 (first pressing step), the first upper die driving part 316*a* refers to a signal from the first linear sensor 336 to check whether or not the fixed upper die 341 reaches the bottom dead center. If the fixed upper die 341 reaches the bottom dead center, the process proceeds to the step S305. Otherwise the fixed upper die 341 continues to be lowered.

Figure 22:
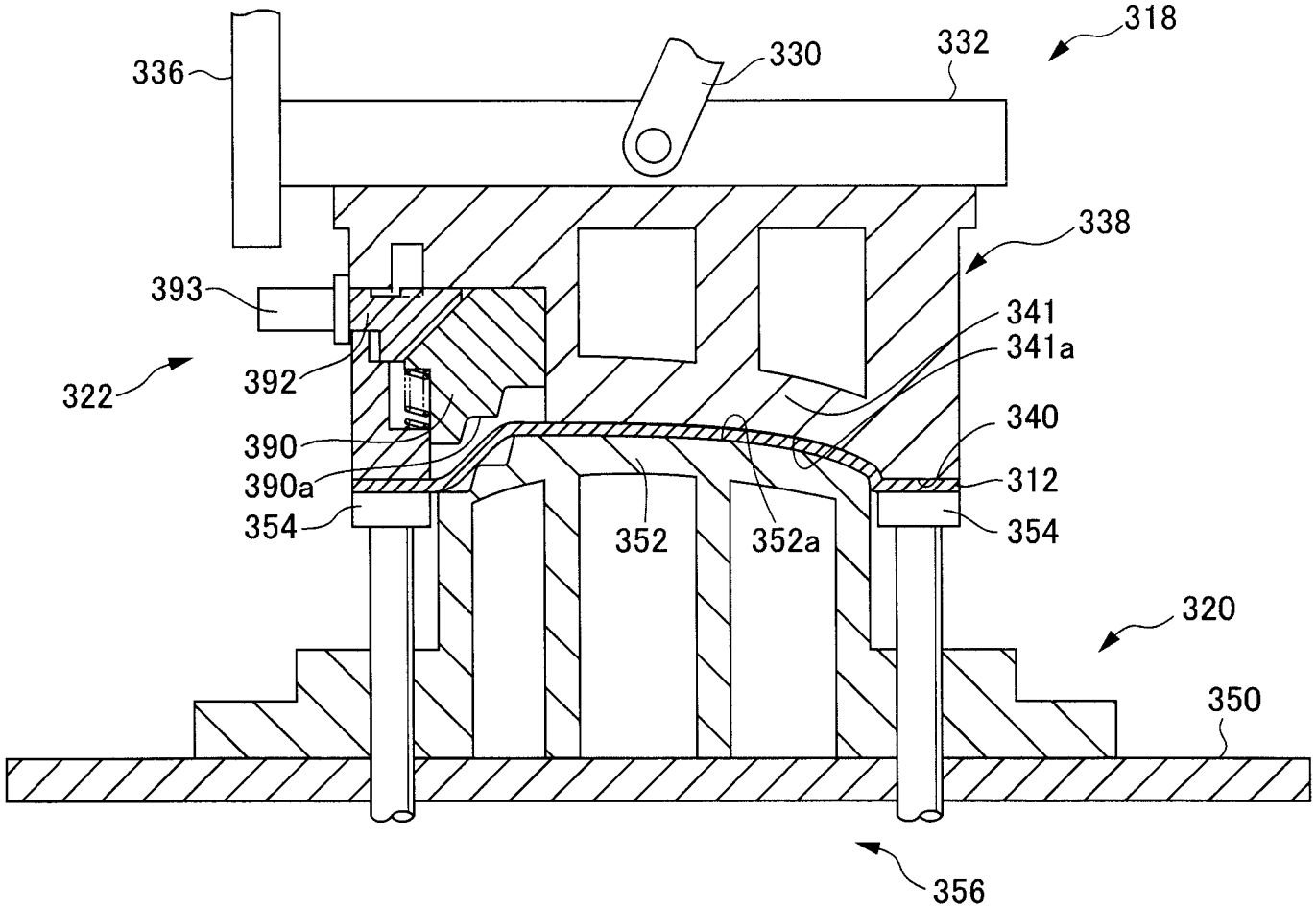
FIG. 22 is a part enlarged section view of a pressing device when a fixed upper die is lowered to the bottom dead center with the second upper die embedded.

In the step S305 (first pressing step), the fixed upper die 341 and the blank holder 354 stop to be lowered. At this time, the steel sheet 312 is placed between the die face 341*a* of the fixed upper die 341 and the die face 352*a* of the lower die 352 and then press-formed as shown in FIG. 22. Accordingly, the panel upper part 383 of the rear side outer panel 380 of FIG. 17 is formed.

At this point, the steel sheet 312 is held between the holder 340 and the blank holder 354. Therefore, this panel upper part 383 is formed by press-forming of a portion of this steel sheet 312 with fold pressure applied to the steel sheet 312.

In the step S306, the first upper die driving part 316*a* drives an actuator of a movable upper die mechanism (not shown), projects a movable upper die, and then bringing the die face of the movable upper die to be flush with the die face 341*a* of the fixed upper die 341.

In the step S307, the first upper die driving part 316*a* drives a mechanism lock of the movable upper die mechanism (not shown) to lock the movable upper die. At this time, the steel sheet 312 is placed between the die face 341*a* of the fixed upper die 341 and the die face of the movable upper die, and the die face 352*a* of the lower die 352 and then press-formed. Accordingly, the panel lower part 384 of the rear side outer panel 380 of FIG. 17 is formed.

In the step S308 (second pressing step), the die cushion driving part 316*c* lowers the blank holder 354 to the bottom dead point. Accordingly, fold pressure applied to the steel sheet 312 is released.

In the step S309 (second pressing step), the second upper die driving part 316*b* drives the actuator 393, projects the second upper die 390, and then brings the die face 390*a* of the second upper die 390 to be flush with the die face 341*a* of the fixed upper die 341.

Figure 23:
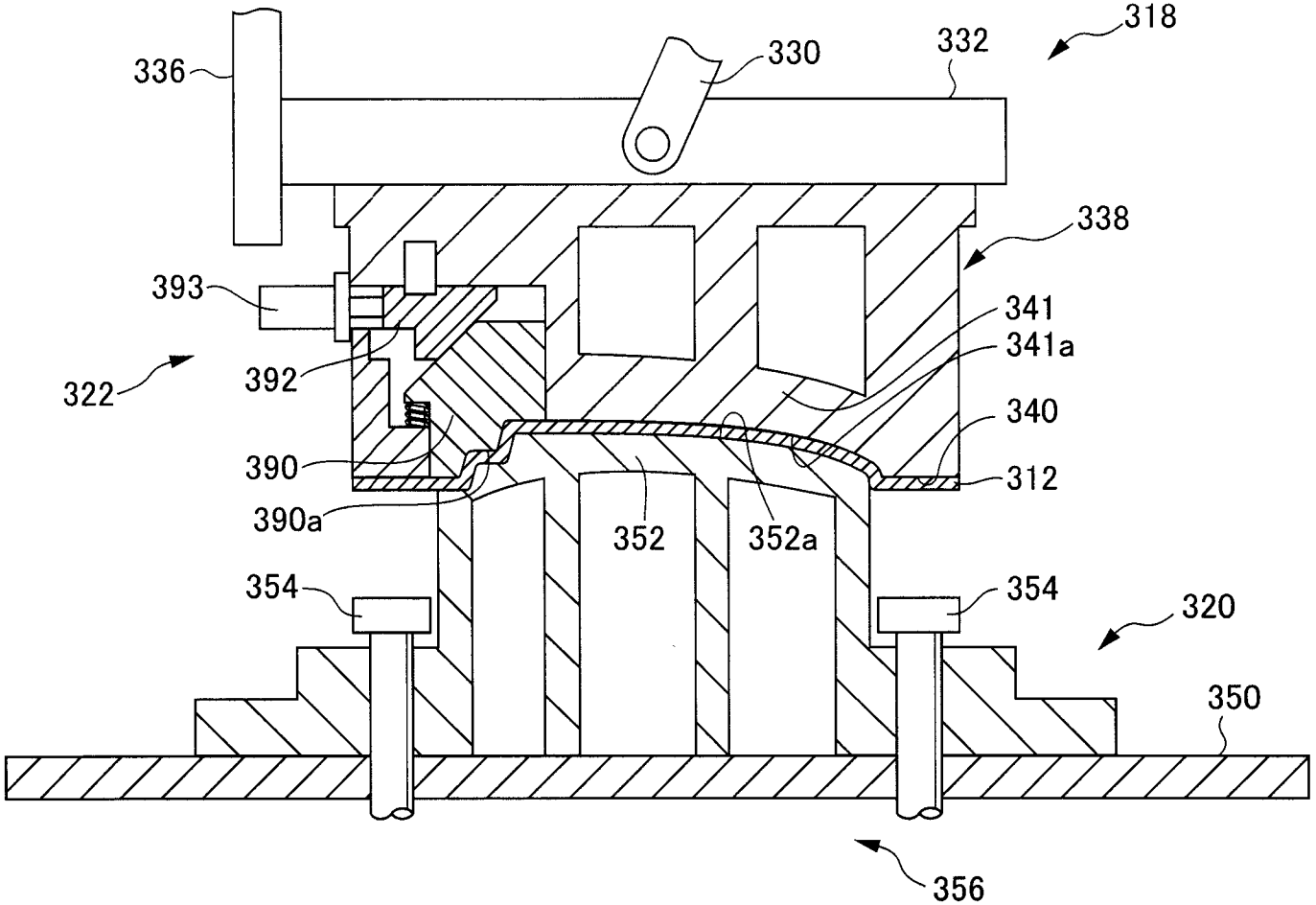
FIG. 23 is a part enlarged section view of a pressing device when a fixed upper die is lowered to the bottom dead center when the second upper die is flush with the first upper die.

In the step S310 (second pressing step), the second upper die driving part 316*b* drives the mechanism lock 394 of the second upper die mechanism 322 to lock the second upper die 390. At this time, the steel sheet 312 is placed between the die face 341*a* of the fixed upper die 341, the die face 390*a* of the second upper die 390, and the die face of the movable upper die; and the die face 352*a* of the lower die 352 and then press-formed, as shown in FIG. 23. Accordingly, the flange part 385 of the rear side outer panel 380 of FIG. 17 is formed.

In addition, the blank holder 354 is located away from the steel sheet 312. Therefore, this flange part 385 is formed by press-forming of the steel sheet 312 with fold pressure released. Especially, the bent part 386 of the flange part 385 is formed by forming the steel sheet 312 by expansion flange forming while the panel upper part 383 is pressed with the fixed upper die 341.

In the step S311, the first upper die driving part 316*a* drives a mechanism lock of the movable upper die mechanism (not shown) to unlock the movable upper die. Therefore, the die face of the movable upper die is embedded from the die face 341*a* of the fixed upper die 341.

In the step S312, the second upper die driving part 316*b* drives the mechanism lock 394 of the second upper die mechanism 322 to unlock the second upper die 390. Therefore, the die face 390*a* of the second upper die 390 is embedded from the die face 341*a* of the fixed upper die 341.

In the step S313, the die cushion driving part 316*c* lifts the blank holder 354 to rehold the processed steel sheet 312 between the blank holder 354 and the holder 340.

In the step S314, the servo motor 324 is rotarily driven to lift the fixed upper die 341 under action of the first upper die driving part 316*a*.

In the step S315, the servo equipment of the die cushion driving part 356 is controlled to lift the blank holder 354 to a panel conveyance position under action of the die cushion driving part 316*c*.

In the step S316, the press-formed steel sheet 312 placed on the blank holder 354 is conveyed to the station of the next step by the predetermined conveyance means.

In the step S317, the die cushion driving part 316*c* relifts the blank holder 354 to bring the blank holder 354 to reach the processing stand-by position and then place the unprocessed steel sheet 312 on the predetermined position. In this period, the fixed upper die 341 continues to be lifted.

In the step S318, the first upper die driving part 316*a* refers to a signal from the first linear sensor 336 to check whether or not the position of the fixed upper die 341 reaches the top dead center. If the fixed upper die 341 unreaches the top dead center, the fixed upper die 341 continues to be lifted. Otherwise the processing of the steel sheet 312 ends.

Hereinbefore, the pressing method using the pressing device 310 is described in one flow chart. However, for example, each driving part of the first upper die driving part 316*a*, the second upper die driving part 316*b*, and the die cushion driving part 316*c* may synchronously check each other but operate independently.

According to the present embodiment, the following effect is attained.

(6) According to the pressing method and the pressing device of the present embodiment, in the second pressing step, the blank holder 354 is lowered to release fold pressure, whereby a material becomes flowable between the second upper die 390 and the lower die 352. The steel sheet 312 is formed by expansion flange forming to form the bent part 386 of a formed article under this condition, which can prevent cracks due to material shortage from being generated on a formed article (rear side outer panel 380). In addition, the panel upper part 383 and the panel lower part 384 is press-formed before the bent part 386 to be formed by expansion flange forming, which can prevent wrinkles from being generated at the panel upper part 383 adjacent to this bent part 386.

(7) In the second pressing step, the remaining portion of the steel sheet 312 is formed by expansion flange forming with maintenance of a condition the panel upper part 383 formed in the first pressing step is pressed with the fixed upper die 341, which can reliably prevent wrinkles from being generated at the panel upper part 383 adjacent to the bent part 386 of the rear side outer panel 380.

Fourth Embodiment

Figure 24:
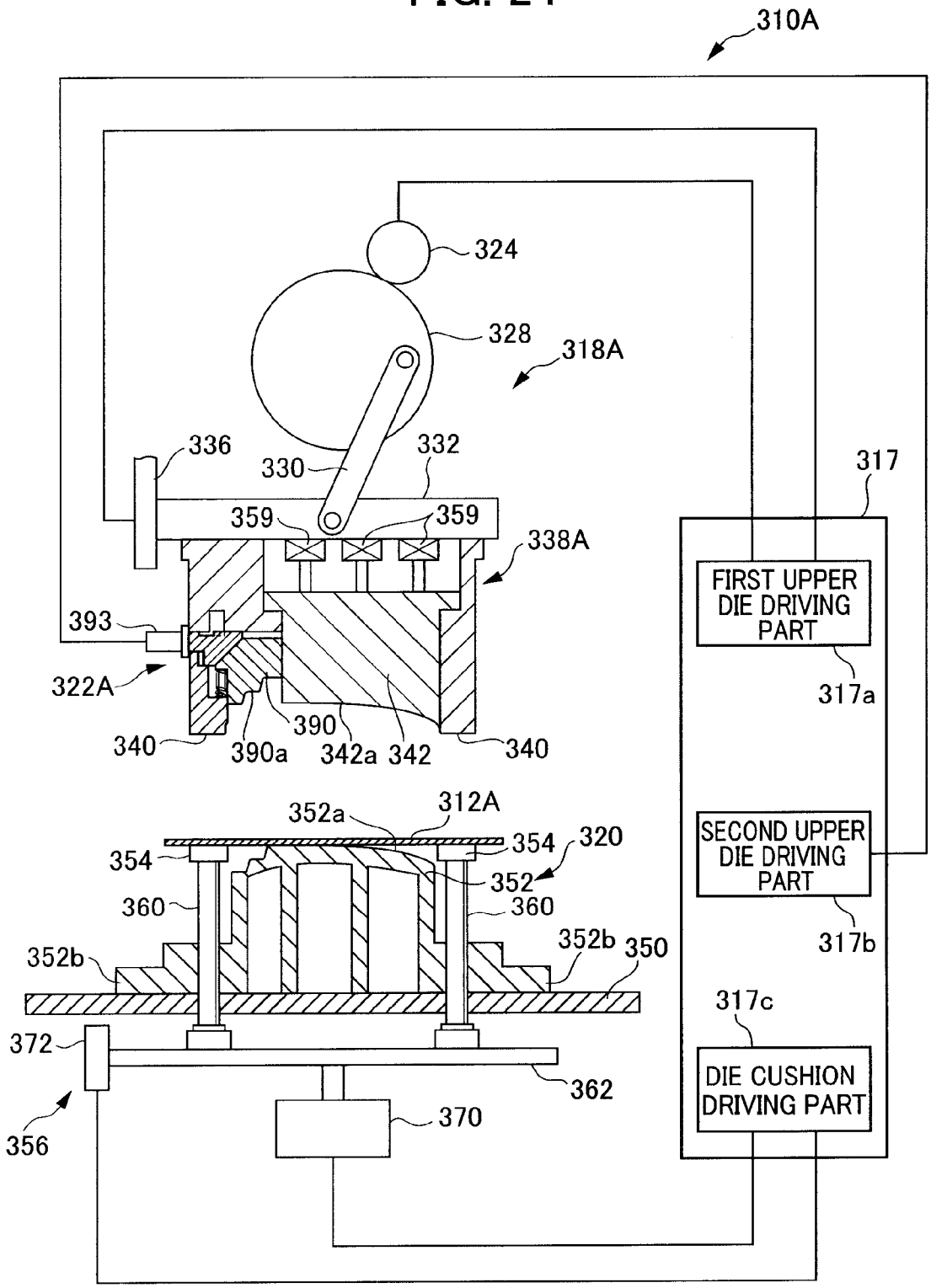
FIG. 24 is a pattern diagram illustrating the structure of a pressing device according to the fourth embodiment of the present invention.

The fourth embodiment of the present invention is described below with reference to FIGS. 24-30. In the following description regarding the fourth embodiment, the same reference number is assigned to the same components and explanations as those of the above-mentioned third embodiment are omitted or simplified. FIG. 24 is a pattern diagram illustrating the partial structure of the pressing device 310A according to the fourth embodiment of the present invention. Specifically, FIG. 24 is an A-A sectional view of the rear side outer panel 380 shown in FIG. 17.

In the pressing device 310A of the fourth embodiment, the structures of the first upper die mechanism 318A, the second upper die mechanism 322A, and the control part 317 are different from that of the pressing device 310 of the fourth embodiment.

The pressing device 310A has the lower die mechanism 320 having the lower die (second die) 352 placed at the lower side of the steel sheet (work) 312A, the first upper die mechanism (advancing and retrieving mechanism) 318A bringing the first upper die (first form) 338A to approach (advance) to and isolate (retrieved) from the lower die 352, the second upper die mechanism 322A provided in the first upper die 338A, bringing the second upper die 390 to approach to and isolate from the lower die 352, and the control part 317 (control means) controlling the lower die mechanism 320, the first upper die mechanism 318A, and the second upper die mechanism 322A.

Figure 25:
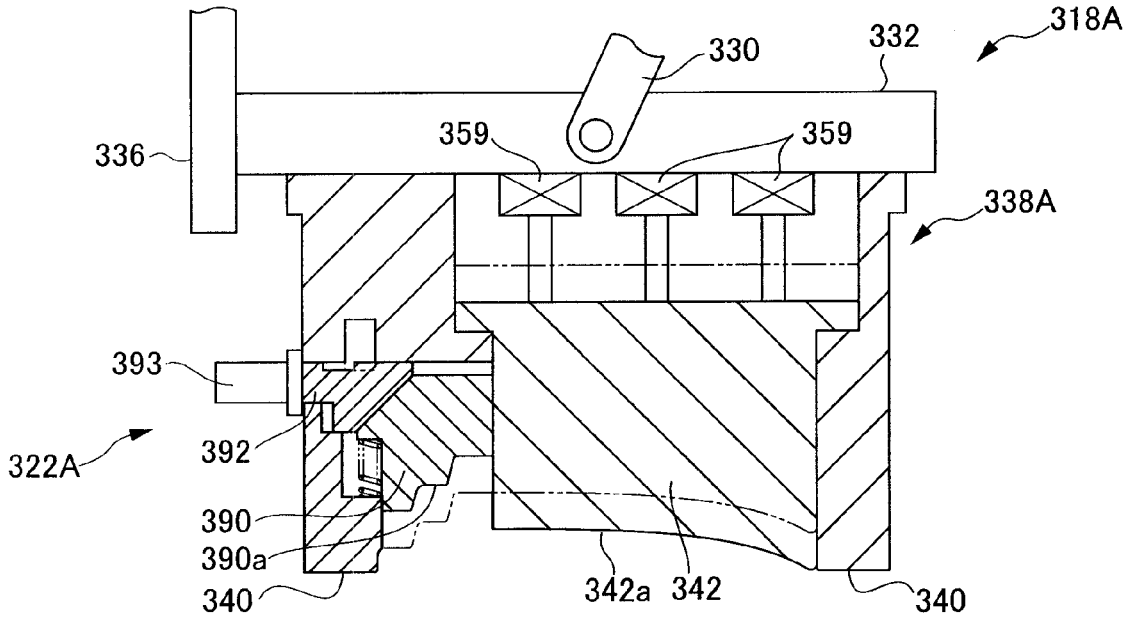
FIG. 25 is a sectional view illustrating the structure of the first upper die mechanism and the second upper die mechanism.

FIG. 25 is a sectional view illustrating the structures of the first upper die 338A and the second upper die mechanism 322A. The first upper die 338A has the movable upper die 342 provided to be vertically slidable to the sliding 332 and the ring-like holder 340 provided around this movable upper die 342.

A plurality of the gas springs 359 extending in the sliding direction of the movable upper die 342 are installed between the movable upper die 342 and the slider 332. These gas springs 359 bias the movable upper die 342 downward at all the time. FIGS. 24 and 25 illustrate the state in which these gas springs 359 fully expands.

In addition, these gas springs 359 shrink upward, resisting this suppress strength from the state in which the gas springs 159 fully expands, when suppress strength required for press-forming of the steel sheet 312 continues to be applied to the die face 342*a* of the second upper die 342. Accordingly, these gas springs 389 can retrieve the movable upper die 342 to the position represented by the dashed line of FIG. 25. Furthermore, when the above-mentioned suppress strength is not applied to the die face 342*a* of the movable upper die 342, the gas springs 359 fully expands under the own weight of the movable upper die 342.

The fixed upper die fixed to the slider 332 is provided on the first upper die 338A, which is not shown in the figures. The die face of this fixed upper die is formed so as to be flush with the die face 342*a* of the movable upper die 342 retrieved above. These die faces of the movable upper die 342 and the fixed upper die are formed in accordance with the panel upper part 383 and the panel lower part 384 on the panel main body 381, respectively.

The second upper die mechanism 322A can move the second upper die 390 vertically by the actuator 393 and lock the second upper die 390 by the mechanism lock 394 in the same way as that of the above-mentioned third embodiment. FIG. 25 illustrates the state in which the second upper die 390 is retrieved above. Meanwhile, the second upper die 390 to be projected downward is represented by the dashed line of FIG. 25. In this condition, the die face 390*a* of the second upper die 390 is flushing with the die face 342*a* of the movable upper die 342 retrieved above. In the case in which the die face 342*a* has a curved surface, the die face 390*a* and the die face 342*a* have the same curved surface.

Figure 26:
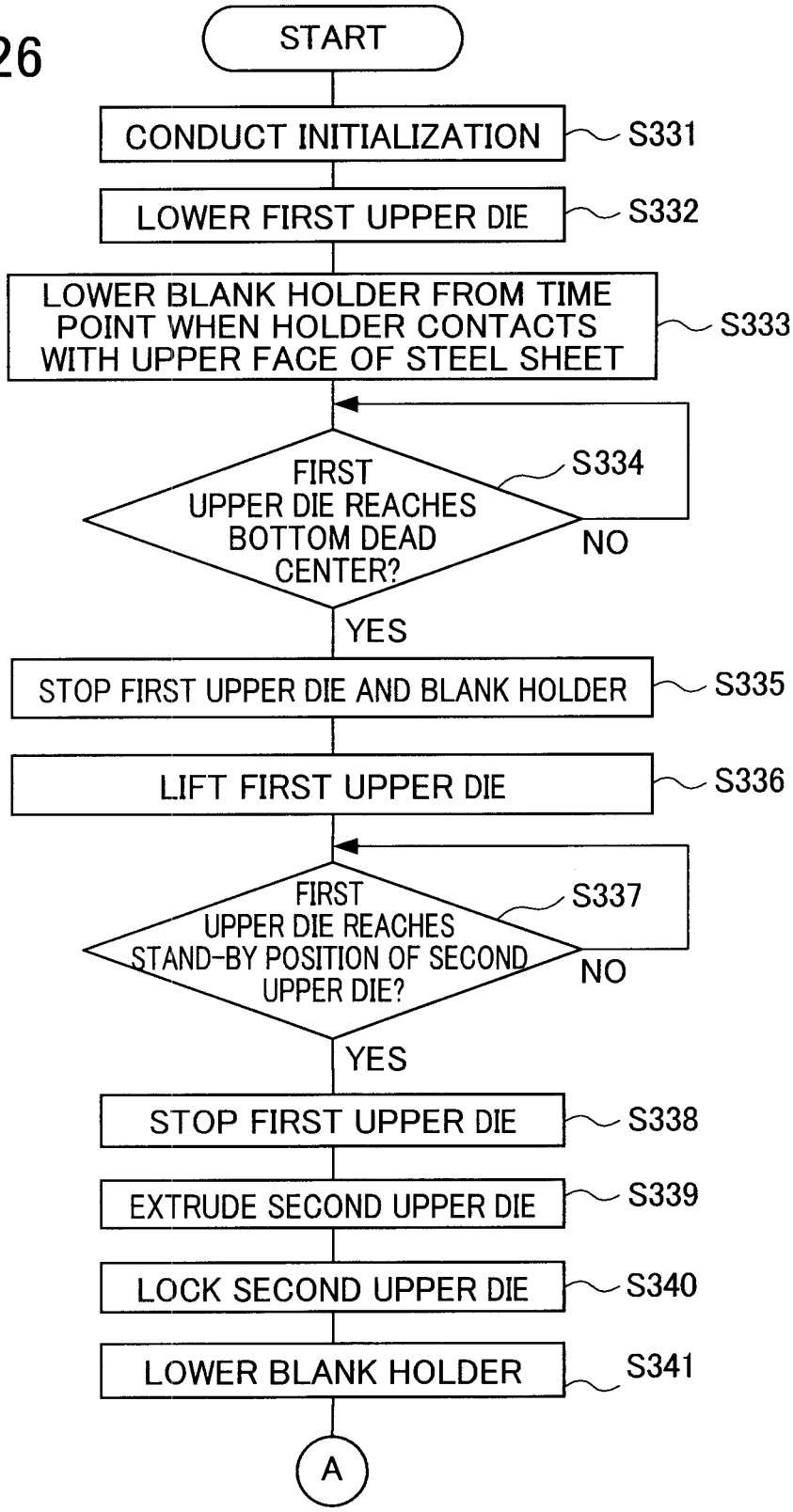
FIG. 26 is a flow chart (I) illustrating the steps of the pressing method according to the embodiment.
Figure 27:
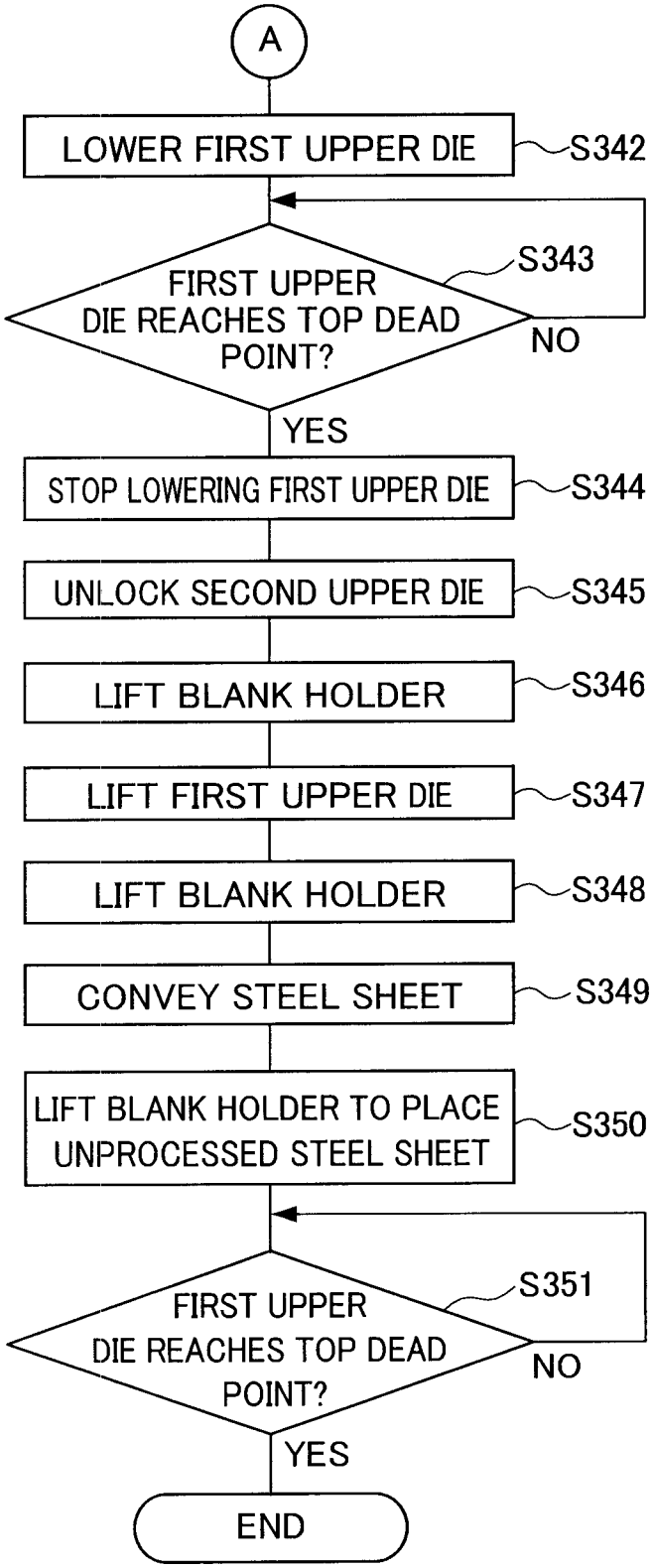
FIG. 27 is a flow chart (II) illustrating the steps of the pressing method according to the embodiment.

Then, the method for pressing the steel sheet 312A which is a work by using the pressing device 310A as described above to form the vehicle rear side outer panel 380 as illustrated in FIG. 17 is described below with reference to the flow chart of FIGS. 26 and 27.

Initialization is first conducted in the step S331. Accordingly, the blank holder 354 is lifted to the predetermined position to support the unprocessed steel sheet 312A. At this point, the second upper die 390 of the second upper die mechanism 322A is retrieved above, and the first upper die 338A is lifted to the top dead center.

In the step S332 (first pressing step), the servo motor 324 is rotarily driven to lower the first upper die 338A under action of the first upper die driving part 317*a*.

Figure 28:
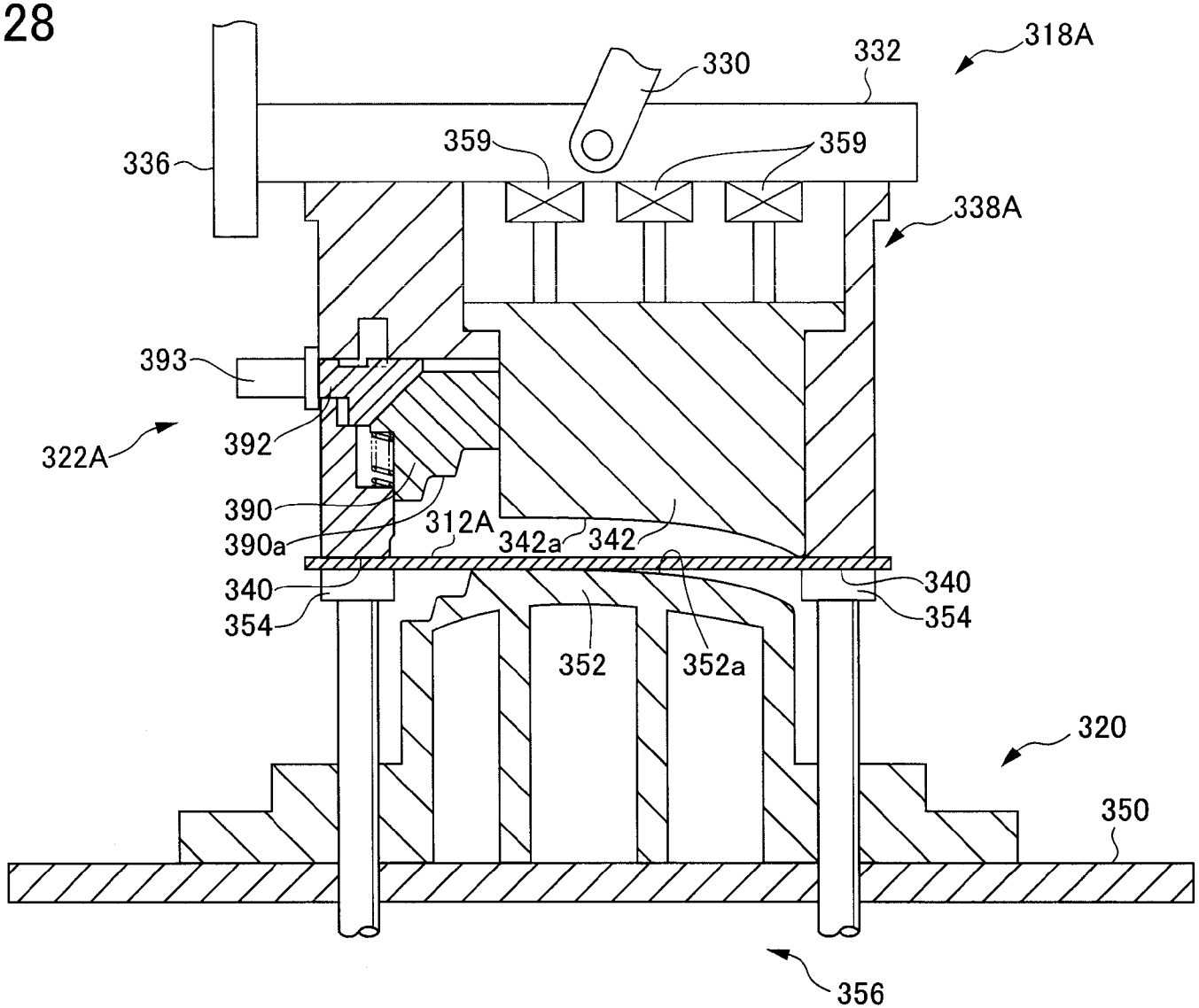
FIG. 28 is a part enlarged section view of a pressing device when the holder of the first upper die contacts with the upper surface of a steel sheet.

When the first upper die 338A is lowered to some extent, the holder 340 contacts with the upper face of the steel sheet 312A, and then the steel sheet 312 is held between the holder 340 and the blank holder 354. Accordingly, fold pressure is applied to the steel sheet 312A as shown in FIG. 28. In addition, from this point when the steel sheet 312A is held between the holder 340 and the blank holder 354 to lower the blank holder 354 under action of the die cushion driving part 317*c* (Step S333).

At this point, the first upper die driving part 317*a* and the die cushion driving part 317*c* generates moderate force so that the black holder 354 presses the lower face of the steel sheet 312A in some degree, thereby conducting pressure control to lower the steel sheet 312A being held firmly. Accordingly, the blank holder 354 is pressed by the holder 340 through the steel sheet 312A, thereby applying moderate pressure to the steel sheet 312A to be depressed. Therefore, the steel sheet 312A is lowered with fold pressure applied.

In the step S334 (first pressing step), the first upper die driving part 317*a* refers to a signal from the first linear sensor 336 to check whether or not the first upper die 338A reaches the bottom dead center. If the first upper die 338A reaches the bottom dead center, the process proceeds to the step S335. Otherwise the first upper die 338A continues to be lowered. Hereinafter, the bottom dead center of the first upper die 338A is the position of the first upper die 338A when the movable upper die 342 is retrieved above by lowering the first upper die 338A. Accordingly, when the first upper die 338A reaches the bottom dead center, the die faces of the movable upper die 342 and the fixed upper die are appressed to the steel sheet 312A.

At this point, while the first upper die 338A is lowered to the bottom dead center, suppress strength continues to be applied to the die face 342*a* of the movable upper die 342 upward. Accordingly, the movable upper die 342 slides upward, shrinking the gas springs 359.

Figure 29:
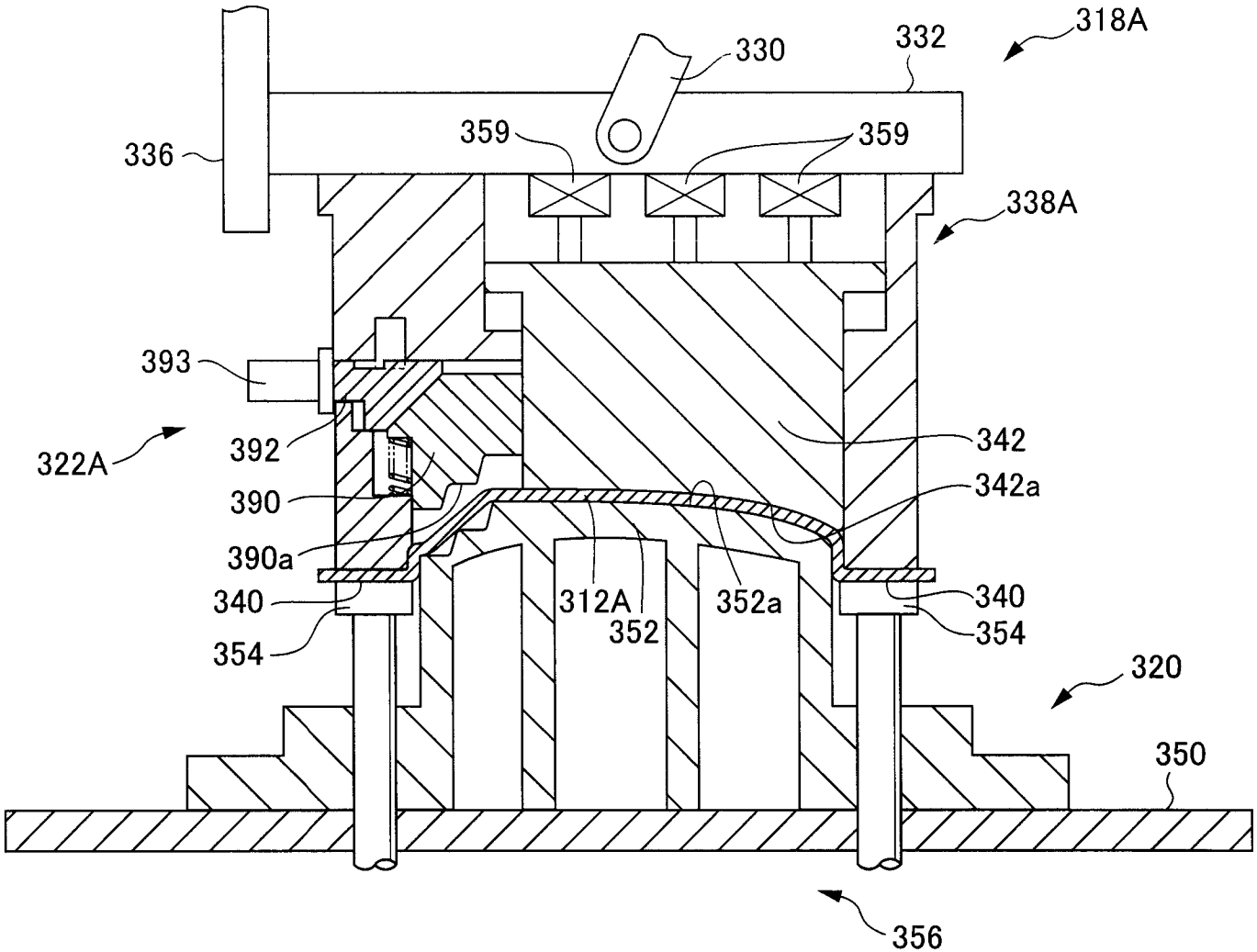
FIG. 29 is a part enlarged section view of a pressing device when the first upper die is lowered to the bottom dead center with the second upper die retrieved above.

In the step S335 (first pressing step), the first upper die 338A and the blank holder 354 stop to be lowered. At this time, the die face 342*a* of the movable upper die 342 is flush with the die face of the fixed upper die (not shown), and the steel sheet 312A is placed between the die face 342*a* of the movable upper die 342 and the die face of the movable upper die, and the die face 352*a* of the lower die 352 and then press-formed as shown in FIG. 29. Accordingly, the panel upper part 383 and the panel lower part 384 of the rear side outer panel 380 of FIG. 17 are formed.

At this point, the steel sheet 312A is held between the holder 340 and the blank holder 354. Therefore, the panel upper part 383 and the panel lower part 384 are formed by press-forming of a portion of this steel sheet 312A with fold pressure applied to the steel sheet 312A.

In the step S336 (second pressing step), the servo motor 324 is rotarily driven to lift the first upper die 338A under action of the first upper die driving part 317*a*.

In the step S337 (second pressing step), the first upper die driving part 317*a* refers to a signal from the first linear sensor 336 to check whether or not the first upper die 338A reaches the stand-by position of the second upper die. If the first upper die 338A reaches the stand-by position of the second upper die, the process proceeds to the step S338. Otherwise the first upper die 338A continues to be lifted. Hereinafter, the stand-by position of the second upper die is the position of the first upper die 338A capable of projecting the second upper die 390 downward.

In the step S338 (second pressing step), the first upper die driving part 317*a* stops the rotating of the servo motor 324 to stop the first upper die 338A at the stand-by position of the second upper die.

In the step S339 (second pressing step), the second upper die driving part 317*b* drives the actuator 393 of the second upper mechanism 322A to project the second upper die 390 downward.

In the step S340 (second pressing step), the second upper die driving part 317*b* drives the mechanism lock 394 of the second upper die mechanism 322A to lock the second upper die 390.

In the step S341 (second pressing step), the die cushion driving part 317*c* lowers the blank holder 354 to the bottom dead point. Accordingly, fold pressure applied to the steel sheet 312A is released.

In the step S342 (second pressing step), the servo motor 324 is rotarily driven to lower the first upper die 338A under action of the first upper die driving part 317*a*.

In the step S343 (second pressing step), the first upper die driving part 317*a* refers to a signal from the first linear sensor 336 to check whether or not the first upper die 338A reaches the bottom dead center. If the first upper die 338A reaches the bottom dead center, the process proceeds to the step S344. Otherwise the first upper die 338A continues to be lowered.

Figure 30:
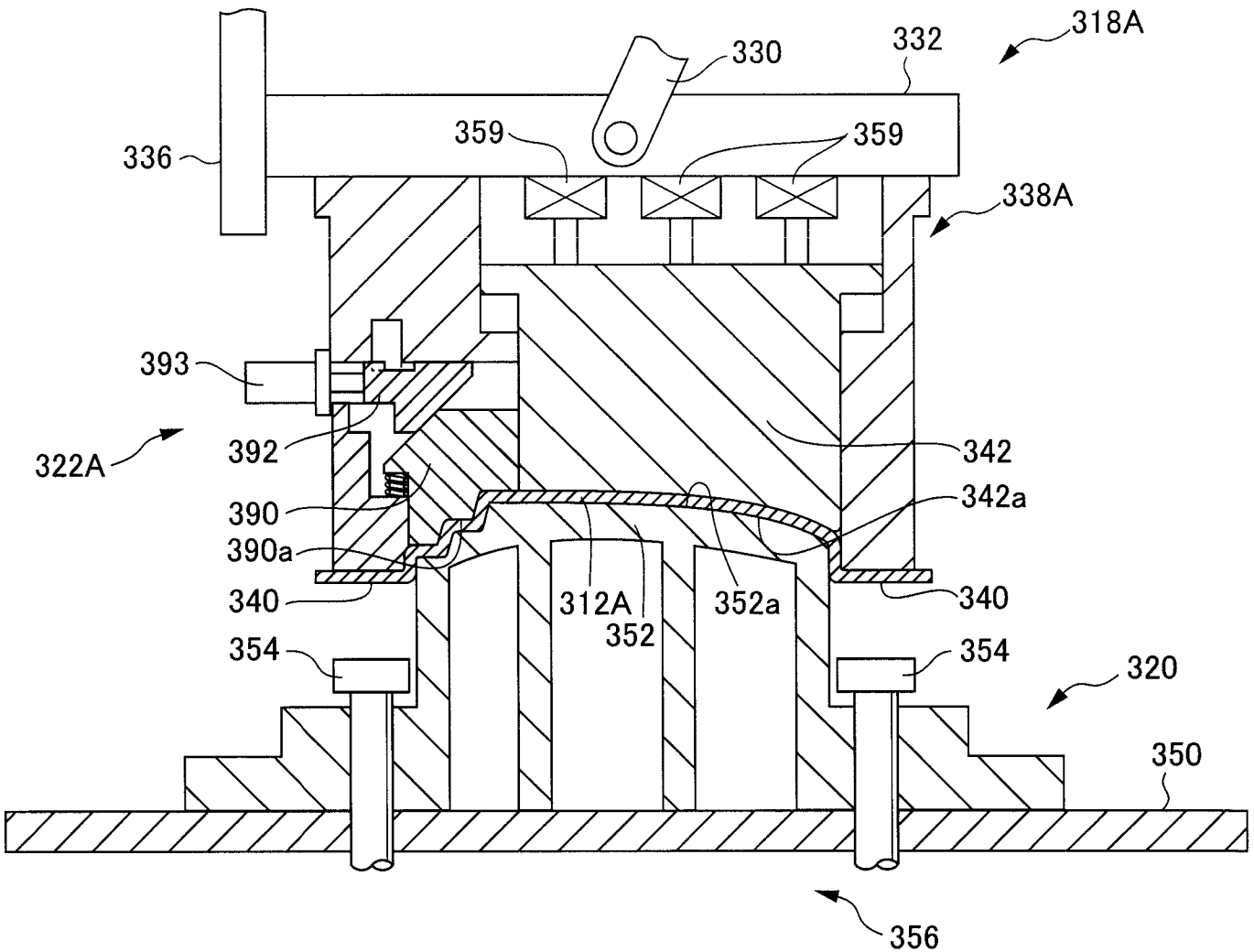
FIG. 30 is a part enlarged section view of a pressing device when the first: upper die is lowered to the bottom dead center with the second upper die being projected downward.

In the step S344 (second pressing step), the first upper die driving part 317*a* stops the lowering of the first upper die 338A. At this time, the steel sheet 312A is placed between the die face 342*a* of the movable upper die 342, the die face 390*a* of the second upper die 390, and the die face of the fixed upper die; and the die face 352*a* of the lower die 352 and then press-formed, as shown in FIG. 30. Accordingly, the flange part 385 of the rear side outer panel 380 of FIG. 17 is formed.

In addition, the blank holder 354 is located away from the steel sheet 312A at this time. Therefore, the flange part 385 is formed by press-forming of the steel sheet 312A with fold pressure released. Especially, the bent part 386 of the flange part 385 is formed by forming the steel sheet 312A by expansion flange forming with maintenance that the panel upper part 383 is pressed with the movable upper die 342.

In the step S345, the second upper die driving part 317*b* drives the mechanism lock 394 of the second upper die mechanism 322A to unlock the second upper die 390. Accordingly, the second upper die 390 is retrieved upward.

In the step S346, the die cushion driving part 316*c* lifts the blank holder 354 to rehold the processed steel sheet 312A between the die cushion driving part 316*c* and the holder 340.

In the step S347, the servo motor 324 is rotarily driven to lift the first upper die 338A under action of the first upper die driving part 317*a*.

In the step S348, the servo equipment of the die cushion mechanism 356 is controlled to lift the blank holder 354 to a panel conveyance position under action of the die cushion driving part 317*c*.

In the step S349, the press-formed steel sheet 312A placed on the blank holder 354 is conveyed to the station of the next step by the predetermined conveyance means.

In the step S350, the die cushion driving part 317*c* relifts the blank holder 354 to bring the blank holder 354 to reach the processing stand-by position and then place the unprocessed steel sheet 312A on the predetermined position. In this period, the first upper die 338A continues to be lifted.

In the step S351, the first upper die driving part 317*a* refers to a signal from the first linear sensor 336 to check whether or not the position of the first upper die 338A reaches the top dead center. If the first upper die 338A unreaches the top dead center, the first upper die 338A continues to be lifted. Otherwise the processing of the steel sheet 312A ends.

Hereinbefore, the pressing method using the pressing device 310A is described in one flow chart. However, for example, each driving part of the first upper die driving part 317*a*, the second upper die driving part 317*b*, and the die cushion driving part 317*c* may synchronously check each other but operate independently.

According to the above-mentioned fourth embodiment, the same effect as that of the above-mentioned third embodiment is attained. While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention.

The invention claimed is:

1. A pressing device forming a formed article having a character line, comprising:

a first die and a second die between which a work is placed;

an advancing and retrieving mechanism advancing the first die to and retrieving the first die from the second die;

a holder holding the work to apply fold pressure; and a control part for controlling the advancing and retrieving mechanism and the holder, wherein the first die is divided into a first panel die and a second panel die on the character line of the formed article, the holder is placed at the sides of the first panel die and the second panel die and, the control part conducts press-forming of the work by way of only the second panel die under a condition in which fold pressure by the holder at the side of the first panel die is increased to be larger than fold pressure by the holder at the side of the second panel die, and then forms the work by way of the first panel die under a condition in which the fold pressure by the holder at the side of the first panel die is reduced to less than during press-forming by way of the second panel die.

2. The pressing device according to claim 1, wherein the holder at the side of the first panel die is provided with a fold pressure adjustment mechanism adjusting fold pressure applied to the work, and the control part controls the fold pressure adjustment mechanism to increase fold pressure by the holder at the side of the first panel die to be larger than that by the holder at the side of the second panel die.

3. The pressing device according to claim 1, wherein upon press-forming of the work with the first panel die, the work is press-formed with the first panel die while being pressed with the second panel die.

4. A pressing method for forming a formed article on which a character as a boundary is divided into a first panel face and a second panel face, comprising:

a first pressing step of conducting press-forming of only the second panel face under a condition in which fold pressure applied to the side of a first panel face of a work is increased to be larger than that applied to the side of the second panel face; and a second pressing step of conducting press-forming of the first panel face under a condition in which the fold pressure applied to the side of the first panel face is reduced to less than during the first pressing step.

5. The pressing method according to claim 4, wherein in the second pressing step, the first panel face is press-formed with maintenance of a condition that the second panel is pressed.

6. A pressing method of a formed article having a character line, comprising, a first pressing step of conducting of press-forming of a portion of a work to form a portion including a character line; and a second pressing step of conducting of press-forming of the remaining portion of the work, wherein in the first pressing step, an end of the work is clamped, a clamping position is made to descend to a predetermined position, and then under a condition in which the end of the work and a position of a remaining portion of the work are suspended, press-forming is conducted on a portion of the work.

7. The pressing method of a formed article according to claim 6, wherein in the second pressing step, with maintenance of a condition that a portion of the work is pressed, the remaining portion of the work is press-formed.

8. A pressing device conducting press-forming of a formed article having a character line, comprising:

a first die and a second die between which a work is placed, a blank holder that is provided at a position opposing a holder projecting from a die face of the first die and that clamps an end of the work together with the holder;

an advancing and retrieving mechanism that advances and retrieves the first die relative to the second die and the blank holder; and a control part for controlling the advancing and retrieving mechanism, wherein the first die is divided into a plurality of divided dies, one of the plurality of divided dies is a character line die placed over a character line of the formed article, and the control part causes the first die to advance towards the second die and the blank holder so as to clamp an end of the work with the holder and the blank holder, lowers a clamping position to a predetermined position, then under a condition in which the first die is suspended, conducts press-forming of a portion of the work with the character line die and then press-forming of the remaining portion of the work with the rest of the divided dies.

9. The pressing device according to claim 8, wherein upon press-forming of the remaining portion of the work, with maintenance of a condition that the work is pressed with the character line die, the control part conducts press-forming of the remaining portion of the work with the rest of divided dies.

10. A method of pressing a work into a formed article having an end part formed by expansion flange forming, the method comprising:

a first pressing step of forming a portion of the work by press-forming the work between a first upper die and a second die while fold pressure is applied to the work; and a second pressing step of forming a remaining portion of the work by expansion flange forming the work between a second upper die and the second die while the fold pressure is released and the work is held between the first upper die and the second die.

11. A pressing device that press-forms a work into a formed article having an end part formed by expansion flange forming, the pressing device comprising:

a first die and a second die between which the work is placed, wherein the first die includes a fixed upper die and a second upper die;

an advancing and retrieving mechanism advancing the first die to and retrieving the first die from the second die;

a second upper die mechanism disposed in the first upper die that moves the second upper die toward and away from the second die;

a holder holding the work; and a control part for controlling the advancing and retrieving mechanism, the second upper die mechanism, and the holder, wherein the control part controls the first upper die and the second die to form a portion of the work by press-forming while the work held by the holder, and then controls the second upper die and the second die to form a remaining portion of the work by expansion flange forming while the work is unheld by the holder and held between the first upper die and the second die to form the end part.

* * * * *